US010587042B2

(12) United States Patent
Bily et al.

(10) Patent No.: US 10,587,042 B2
(45) Date of Patent: Mar. 10, 2020

(54) DYNAMIC POLARIZATION AND COUPLING CONTROL FROM A STEERABLE CYLINDRICALLY FED HOLOGRAPHIC ANTENNA

(71) Applicant: Kymeta, Inc., Redmond, WA (US)

(72) Inventors: Adam Bily, Seattle, WA (US); Nathan Kundtz, Kirkland, WA (US); Mikala Johnson, Seattle, WA (US)

(73) Assignee: KYMETA CORPORATION, Redmond, WA (US)

( * ) Notice: Subject to any disclaimer, the term of this patent is extended or adjusted under 35 U.S.C. 154(b) by 0 days.

(21) Appl. No.: 15/847,545

(22) Filed: Dec. 19, 2017

(65) Prior Publication Data

US 2018/0166780 A1 Jun. 14, 2018

Related U.S. Application Data

(63) Continuation of application No. 14/550,178, filed on Nov. 21, 2014, now Pat. No. 9,887,456.

(51) Int. Cl.

| | |
|---|---|
| ***H01Q 3/24*** | (2006.01) |
| ***H01Q 21/00*** | (2006.01) |
| ***H01Q 21/20*** | (2006.01) |
| ***H01Q 21/06*** | (2006.01) |
| ***H01Q 3/34*** | (2006.01) |

(Continued)

(52) U.S. Cl.

CPC ..... *H01Q 3/247* (2013.01); *H01Q 3/34* (2013.01); *H01Q 13/106* (2013.01); *H01Q 21/0012* (2013.01); *H01Q 21/0031* (2013.01); *H01Q 21/065* (2013.01); *H01Q 21/20* (2013.01); *H01Q 3/28* (2013.01); *H01Q 9/0442* (2013.01); *H01Q 21/005* (2013.01)

(58) Field of Classification Search

CPC ..... H01Q 3/24; H01Q 3/247; H01Q 3/28; H01Q 9/42; H01Q 13/106; H01Q 21/0006; H01Q 21/005; H01Q 21/0031; H01Q 21/0012; H01Q 21/065; H01Q 21/20

See application file for complete search history.

(56) References Cited

U.S. PATENT DOCUMENTS

| | | | |
|---|---|---|---|
| 3,714,608 | A | 1/1973 | Barnes |
| 4,291,312 | A | 9/1981 | Kaloi |

(Continued)

FOREIGN PATENT DOCUMENTS

| | | |
|---|---|---|
| CN | 103222109 | 10/2011 |
| JP | S60-199201 | 8/1985 |

(Continued)

OTHER PUBLICATIONS

Takada et al. "A Slot Coupling Control in Circularly Polarized Radial Line SLot Antennas." Digest on Antennas and Propagation Society International Symposium, San Jose, CA, USA, 1989, pp. 1456-1460 vol. 3. (Year: 1989).

(Continued)

*Primary Examiner* — Hoang V Nguyen

(74) *Attorney, Agent, or Firm* — Womble Bond Dickinson (US) LLP

(57) ABSTRACT

An apparatus is disclosed herein for a cylindrically fed antenna and method for using the same. In one embodiment, the antenna comprises an antenna feed to input a cylindrical feed wave and a tunable slotted array coupled to the antenna feed.

19 Claims, 16 Drawing Sheets

(51) Int. Cl.

| | |
|---|---|
| ***H01Q 13/10*** | (2006.01) |
| *H01Q 3/28* | (2006.01) |
| *H01Q 9/04* | (2006.01) |

(56) References Cited

U.S. PATENT DOCUMENTS

| | | | | |
|---|---|---|---|---|
| 4,489,325 | A | 12/1984 | Bauck | |
| 4,819,003 | A | 4/1989 | Goto | |
| 4,920,350 | A | 4/1990 | McGuire | |
| 4,978,934 | A | 12/1990 | Saad | |
| 5,049,895 | A | 9/1991 | Ito | |
| 5,512,906 | A | 4/1996 | Speciale | |
| 5,661,498 | A | 8/1997 | Goto | |
| 6,061,023 | A | 5/2000 | Daniel | |
| 6,075,483 | A | 6/2000 | Gross | |
| 6,211,823 | B1 | 4/2001 | Herring | |
| 6,396,440 | B1 | 5/2002 | Chen | |
| 6,512,906 | B2 | 1/2003 | Hartmut | |
| 6,552,696 | B1 | 4/2003 | Sievenpiper | |
| 6,664,867 | B1 | 12/2003 | Chen | |
| 6,674,408 | B1 | 1/2004 | Chen | |
| 6,791,497 | B2 * | 9/2004 | Winebrand | H01Q 1/38 343/702 |
| 7,307,596 | B1 | 12/2007 | West | |
| 7,466,269 | B2 | 12/2008 | Haziza | |
| 7,889,127 | B2 | 2/2011 | Sajuyigbe | |
| 9,385,435 | B2 | 7/2016 | Bily | |
| 9,450,310 | B2 * | 9/2016 | Bily | H01Q 13/28 |
| 9,806,425 | B2 | 10/2017 | Apostolos | |
| 9,887,456 | B2 | 2/2018 | Bily | |
| 9,893,435 | B2 | 2/2018 | Bily et al. | |
| 2002/0122009 | A1 | 9/2002 | Winebrand et al. | |
| 2004/0227668 | A1 | 11/2004 | Sievenpiper | |
| 2007/0200781 | A1 | 8/2007 | Ahn et al. | |
| 2008/0180339 | A1 | 7/2008 | Yagi | |
| 2008/0224707 | A1 | 9/2008 | Wisler | |
| 2009/0174499 | A1 | 7/2009 | Hiramatsu | |
| 2009/0251385 | A1 | 10/2009 | Xu et al. | |
| 2010/0060534 | A1 | 3/2010 | Oodachi | |
| 2010/0156573 | A1 | 6/2010 | Smith | |
| 2012/0194399 | A1 | 8/2012 | Bily | |
| 2013/0207859 | A1 | 8/2013 | Legay et al. | |
| 2014/0266946 | A1 | 9/2014 | Bily | |
| 2015/0028803 | A1 | 1/2015 | Shevde et al. | |

FOREIGN PATENT DOCUMENTS

| | | | |
|---|---|---|---|
| JP | 60-199201 | A | 10/1985 |
| JP | H02164108 | | 6/1990 |
| JP | 08-008640 | | 1/1996 |
| JP | 08-008640 | A | 1/1996 |
| JP | 3247155 | | 1/2002 |
| JP | 3247155 | B2 | 1/2002 |
| JP | 2003-008341 | | 1/2003 |
| JP | 2003-008341 | A | 1/2003 |
| KR | 10-2003-0015214 | | 2/2003 |
| KR | 10-2013-0141527 | | 12/2013 |
| WO | 2004/082073 | | 9/2004 |
| WO | 2004/082073 | A1 | 9/2004 |
| WO | 2012/050614 | A1 | 4/2012 |
| WO | 2012050614 | | 4/2012 |
| WO | 2013/098795 | A1 | 7/2013 |
| WO | 2013098795 | | 7/2013 |

OTHER PUBLICATIONS

Makoto Ando, Kimio Sakurai, Naohisa Goto, Kunitaka Arimura and Yoshiharu Ito, Radial Line Slot Antenna for 12GHz Satellite TV Reception, Dec. 1985 (pp. 1347-1353).

Radu Marin, "Investigations on Liquid Crystal Reconfigurable Unit Cells for MM-Wave Reflectarrays," Jan. 1, 2008, Retrieved from the Internet: URL/http://tuprints.ulb.tu-damstadt.de/1089/1/dis_Radu_Marin_WebPubl.pdf, 168 pgs.

Office Action received for European Patent Application No. 15751946.3, dated Jul. 5, 2018, 10 pages.

Loecker, C. "Metamaterial Enhanced Phased-Array Antenna." 978-1-4673-5707-4/13 © 2013 IEEE. pp. 1119-1122. (Year: 2013).

Japanese Application No. 2016-553295, Office Action date Aug. 7, 2017, 16 pgs.

International Search Report and Written Opinion received for PCT Patent Application No. PCT/US2015/013099, dated Apr. 24, 2015, 12 pages.

International Preliminary Report on Patentability received for PCT Patent Application No. PCT/US2015/013099, dated Sep. 1, 2016, 11 pages.

Gomez-Tornero, J. etal. "Holographic Surface Leaky-Wave Lenses WithCircularly-Polarized Focused Near-Fields—Part I: Concept , Design and Analysis Theory." IEEE Transactions On Antennas And Propagation, vol. 61, No. 7, Jul. 2013. pp. 3475-3485. (Year: 2013).

A. Sihvola, "Electromagnetic emergence in metamaterials," in Advances in Electromagnetics of Complex Media and Metamaterials, S.Zouhdi, A.Sihvola, and M.Arsalane, eds., vol. 89 of NATO Science Series II: Mathematics, Physics, and Chemistry (Kluwer Academic, 2003), pp. 3-17. (Year: 2003).

CN 201580003442 Chinese Office Action dated Oct. 16, 2018, (15 pages of Translation and 10 pages of original document).

Communication pursuant to Article 94(3) EPC for European Patent Application No. 15751946.3-1205, dated May 9, 2019, 7 pages.

First Office Action CN, U.S. Appl. No. 201580003442.4, dated Feb. 24, 2018, 9 pgs.

Second Chinese Office Action dated Oct. 16, 2018, (9 pages).

Indian Office Action for Application No. 201647024686 dated Mar. 14, 2019.

Office Action received for European Patent Application No. 15751946.3, dated Jul. 5, 2018, 10 pagers.

Office Action received for European Patent Application No. 15751330.0, dated Jul. 23, 2018, 8 pages.

International Search Report and Written Opinion received for PCT Patent Application No. PCT/US2015/012077, dated Apr. 24, 2015, 11 pages.

International Preliminary Report on Patentability received for PCT Patent Application No. PCT/US2015/012077, dated Sep. 1, 2016, 10 pages.

Japanese Office Action for Application No. 2016-553419 dated Mar. 12, 2018, 6 pages.

U.S. Pat. No. 20150028803, Published Jan. 29, 2015, 29 pgs.

A. Sihvola, "Electromagnetic emergence in metamaterials," in Advances in Electromagnetics of Complex Media and Metamaterials, S.Zouhdi, A.Sihvola, and M.Arsalane, eds., vol. 89 of NATO Science Series II: Mathematics, Physics, Physics, and Chemistry (Kluwer Academic, 2003), pp. 3-17. (Year: 2003).

Gomez-Tornero, J. et al. "Holographic Surface Leaky-Wave Lenses With Circularly-Polarized Focused Near-Fields-Part I: Concept, Design and Analysis Theory." IEEE Transactions on Antennas and Propogation, vol. 61, No. 7, Jul. 2013. pp. 3475-3485. (Year: 2013).

Loecker, C. "Metamaterial Enhanced Phased-Array Antenna." 978-1-4673-5707-4/13 (c) 2013 IEEE. pp. 1119-1122. (Year:2013).

Symeonidou, A. "A Novel Microstrip Antenna Array With Metamaterial-Based Electronic Beam Steering At 2.4 GHz." Progress in Electromagnetics Research C, vol. 38, 27-42, 2013 (Year: 2013).

Awai "Artificial Dielectric Resonators for Miniaturized Filters," IEEE Microwave Magazine. Oct. 2008. pp. 55-64. (Year: 2008).

Manasson, V. et al "Electronically Reconfigurable Aperture (ERA): A New Approach for Beam-Steering Technology." IEEE 2010. pp. 673-679. (Year: 2010).

European Application No. 15751330.0, Office Action, dated Sep. 6, 2017, 12 pgs.

Taiwan Application No. 104103553, Office Action dated Oct. 24, 2017, 11 pgs.

Japanese Application No. 2016-553295, Office Action dated Aug. 7, 2017, 16 pgs.

Korean Application No. 10-2016-7016044, Office Action, dated Apr. 20, 2017, 14 pgs.

(56) References Cited

OTHER PUBLICATIONS

PCT Appln. No. PCT/2015/013099 International Search Report and Written Opinion. dated Apr. 24, 2015, 14 pgs.
Notification Concerning Transmittal of International Preliminary Report on Patentability issued for International Patent Application No. PCT/US2015/013099, dated Sep. 1, 2016.
Chinese Office Action for Application No. 201580003431.6 dated Feb. 24, 2018, 8 pages.
Korean Office Action for Application No. 10-2016-7016043 dated Jan. 22, 2018, 27 pages.
Indian Office Action for Application No. 201647024685 dated Feb. 26, 2019, 11 pages.
Taiwanese Office Action for Application No. 104103553 dated Oct. 12, 2018.
European Office Action for Application No. 15 751 330.0-1205, dated Mar. 7, 2019, 7 pages.
European Appln. No. 15 751 946.3 Search Report dated Sep. 7, 2017, 13 pgs.
Ando, M. et al., "A Radial Line Slot Antenna for 12 GHz Satellite TV Reception," IRE Transactions on Antennas and Propagation, vol. 33, No. 12, Dec. 1, 1985, pp. 1347-1353.
Marin, Radu, "Investigations on Liquid Crystal Reconfigureable Unit Cells for MMWave Reflectarrays," Jan. 1, 2008, pp. i-155, XP055401196; URL:http://tuprints.ulb.tu-damstadt.de/1089/1/disss_Radu_Marin_WebPubl.pdf.
Korean Application No. 10-2016-7016043, Office Action, dated Jul. 20, 2017, 21 pgs.
Notification Concerning Transmittal of International Preliminary Report on Patentability issued for International Patent Application No. PCT/US2015/012077, dated Sep. 1, 2016.
P.K. Varlamos, et al., "Electronic Beam Steering Using Switched Parasitic Smart Antenna Arrays," Progress in Electromagnetics Research, PIER 36, 2002, pp. 101-119.
Ovi, et al. "Symmetrical Slot Loading in Eliptical Microstrip Patch Antennas Partially Filled with Mue Negative Metamaterials," PIERS Proceedings, Moscow, Russia, Aug. 19-23, 2012, pp. 542-545.
PCT Appln. No. PCT/US2015/012077 International Search Report and Written Opinion, dated Apr. 24, 2015, 13 pgs.

* cited by examiner

A = Solid black arrow denoting power feed vector from feed location to center of element
B = Dashed orthogonal lines showing perpendicular axes relative to "A"
C = Dashed rectangle encircling slot rotated 45 degrees relative to "B"

A = Elements whose rotation relative to feed pointing vector is equal to -45, comprising Group A B = Elements whose rotation relative to feed pointing vector is equal to +45, comprising Group B

DYNAMIC POLARIZATION AND COUPLING CONTROL FROM A STEERABLE CYLINDRICALLY FED HOLOGRAPHIC ANTENNA

PRIORITY

The present patent application is a continuation of U.S. application Ser. No. 14/550,178, titled "DYNAMIC POLARIZATION AND COUPLING CONTROL FOR A STEERABLE CYLINDRICALLY FED HOLOGRAPHIC ANTENNA," filed Nov. 21, 2014 and which claims priority to and incorporates by reference the corresponding provisional patent application Ser. No. 61/941,801, titled, "Polarization and Coupling Control from a Cylindrically Fed Holographic Antenna" filed on Feb. 19, 2014, as well as corresponding provisional patent application Ser. No. 62/012,897, titled "A Metamaterial Antenna System for Communications Satellite Earth Stations, filed Jun. 16, 2014.

FIELD OF THE INVENTION

Embodiments of the present invention relate to the field of antennas; more particularly, embodiments of the present invention relate to an antenna that is cylindrically fed.

BACKGROUND OF THE INVENTION

Thinkom products achieve dual circular polarization at Ka-band using PCB-based approaches, generally using a Variable Inclined Transverse Stub, or "VICTS" approach with two types of mechanical rotation. The first type rotates one array relative to another, and the second type rotates both in azimuth. The primary limitations are scan range (Elevation between 20 and 70 degrees, no broadside possible) and beam performance (sometimes limiting to Rx only).

Ando et al., "Radial line slot antenna for 12 GHz DBS satellite reception", and Yuan et al., "Design and Experiments of a Novel Radial Line Slot Antenna for High-Power Microwave Applications", discuss various antennas. The limitation of the antennas described in both these papers is that the beam is formed only at one static angle. The feed structures described in the papers are folded, dual layer, where the first layer accepts the pin feed and radiates the signal outward to the edges, bends the signal up to the top layer and the top layer then transmits from the periphery to the center exciting fixed slots along the way. The slots are typically oriented in orthogonal pairs, giving a fixed circular polarization on transmit and the opposite in receive mode. Finally, an absorber terminates whatever energy remains.

"Scalar and Tensor Holographic Artificial Impedance Surfaces", Authors Fong, Colburn, Ottusch, Visher, Sievenpiper. While Sievenpiper has shown how a dynamic scanning antenna would be achieved, the polarization fidelity maintained during scanning is questionable. This is because the required polarization control is dependent on the tensorial impedance required at each radiating element. This is most easily achieved by element-wise rotation. But as the antenna scans, the polarization at each element changes, and thus the rotation required also changes. Since these elements are fixed and cannot be rotated dynamically, there is no way to scan and maintain polarization control.

Industry-standard approaches to achieving beam scanning antennas having polarization control usually use either mechanically-rotated dishes or some type of mechanical movement in combination with electronic beam steering. The most expensive class of options is a full phased-array antenna. Dishes can receive multiple polarizations simultaneously, but require a gimbal to scan. More recently, combining of mechanical movement in one axis with electronic scanning in an orthogonal axis has resulted in structures with a high aspect ratio that require less volume, but sacrifice beam performance or dynamic polarization control, such as Thinkom's system.

Prior approaches use a waveguide and splitter feed structure to feed antennas. However, the waveguide designs have impedance swing near broadside (a band gap created by 1-wavelength periodic structures); require bonding with unlike CTEs; have an associated ohmic loss of the feed structure; and/or have thousands of vias to extend to the ground-plane.

SUMMARY OF THE INVENTION

An apparatus is disclosed herein for a cylindrically fed antenna and method for using the same. In one embodiment, the antenna comprises an antenna feed to input a cylindrical feed wave and a tunable slotted array coupled to the antenna feed.

BRIEF DESCRIPTION OF THE DRAWINGS

The present invention will be understood more fully from the detailed description given below and from the accompanying drawings of various embodiments of the invention, which, however, should not be taken to limit the invention to the specific embodiments, but are for explanation and understanding only.

DETAILED DESCRIPTION OF THE PRESENT INVENTION

Figure 1:
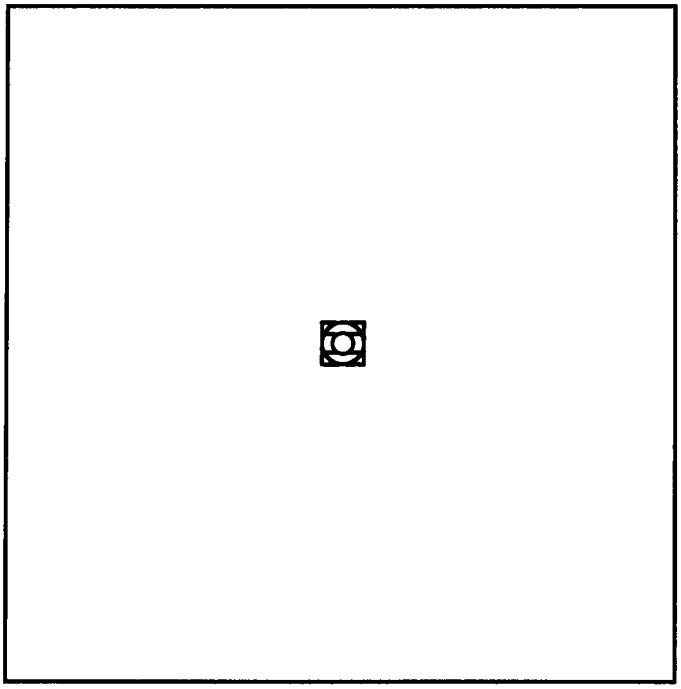
FIG. 1 illustrates a top view of one embodiment of a coaxial feed that is used to provide a cylindrical wave feed.

Embodiments of the invention include an antenna design architecture that feeds the antenna from a central point with an excitation (feed wave) that spreads in a cylindrical or concentric manner outward from the feed point. The antenna works by arranging multiple cylindrically fed subaperture antennas (e.g., patch antennas) with the feed wave. In an alternative embodiment, the antenna is fed from the perimeter inward, rather than from the center outward. This can be helpful because it counteracts the amplitude excitation decay caused by scattering energy from the aperture. Scattering occurs similarly in both orientations, but the natural taper caused by focusing of the energy in the feed wave as it travels from the perimeter inward counteracts the decreasing taper caused by the intended scattering.

Embodiments of the invention include a holographic antenna based on doubling the density typically required to achieve holography and filling the aperture with two types of orthogonal sets of elements. In one embodiment, one set of elements is linearly oriented at +45 degrees relative to the feed wave, and the second set of elements is oriented at −45 degrees relative to the feed wave. Both types are illuminated by the same feed wave, which, in one form, is a parallel plate mode launched by a coaxial pin feed.

In the following description, numerous details are set forth to provide a more thorough explanation of the present invention. It will be apparent, however, to one skilled in the art, that the present invention may be practiced without these specific details. In other instances, well-known structures and devices are shown in block diagram form, rather than in detail, in order to avoid obscuring the present invention.

Some portions of the detailed descriptions which follow are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

Overview of an Example of the Antenna System

Embodiments of a metamaterial antenna system for communications satellite earth stations are described. In one embodiment, the antenna system is a component or subsystem of a satellite earth station (ES) operating on a mobile platform (e.g., aeronautical, maritime, land, etc.) that operates using either Ka-band frequencies or Ku-band frequencies for civil commercial satellite communications. Note that embodiments of the antenna system also can be used in earth stations that are not on mobile platforms (e.g., fixed or transportable earth stations).

In one embodiment, the antenna system uses surface scattering metamaterial technology to form and steer transmit and receive beams through separate antennas. In one embodiment, the antenna systems are analog systems, in contrast to antenna systems that employ digital signal processing to electrically form and steer beams (such as phased array antennas).

In one embodiment, the antenna system is comprised of three functional subsystems: (1) a wave propagating structure consisting of a cylindrical wave feed architecture; (2) an array of wave scattering metamaterial unit cells; and (3) a control structure to command formation of an adjustable radiation field (beam) from the metamaterial scattering elements using holographic principles.

Examples of Wave Propagating Structures

FIG. 1 illustrates a top view of one embodiment of a coaxial feed that is used to provide a cylindrical wave feed. Referring to FIG. 1, the coaxial feed includes a center conductor and an outer conductor. In one embodiment, the cylindrical wave feed architecture feeds the antenna from a central point with an excitation that spreads outward in a cylindrical manner from the feed point. That is, a cylindrically fed antenna creates an outward travelling concentric feed wave. Even so, the shape of the cylindrical feed antenna around the cylindrical feed can be circular, square or any shape. In another embodiment, a cylindrically fed antenna creates an inward travelling feed wave. In such a case, the feed wave most naturally comes from a circular structure.

Figure 2A:
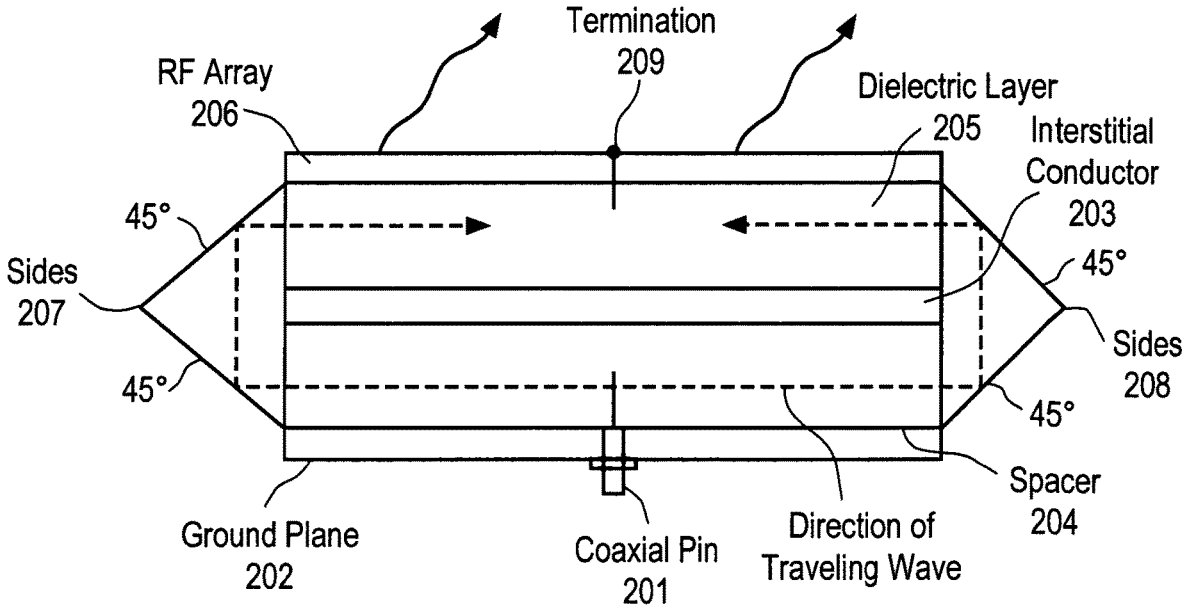
FIGS. 2A and 2B illustrate side views of embodiments of a cylindrically fed antenna structure.

FIG. 2A illustrates a side view of one embodiment of a cylindrically fed antenna structure. The antenna produces an inwardly travelling wave using a double layer feed structure (i.e., two layers of a feed structure). In one embodiment, the antenna includes a circular outer shape, though this is not required. That is, non-circular inward travelling structures can be used. In one embodiment, the antenna structure in FIG. 2A includes the coaxial feed of FIG. 1.

Referring to FIG. 2A, a coaxial pin 201 is used to excite the field on the lower level of the antenna. In one embodiment, coaxial pin 201 is a 50Ω coax pin that is readily available. Coaxial pin 201 is coupled (e.g., bolted) to the bottom of the antenna structure, which is conducting ground plane 202.

Separate from conducting ground plane 202 is interstitial conductor 203, which is an internal conductor. In one embodiment, conducting ground plane 202 and interstitial conductor 203 are parallel to each other. In one embodiment, the distance between ground plane 202 and interstitial conductor 203 is 0.1-0.15". In another embodiment, this distance may be $\lambda/2$, where $\lambda$ is the wavelength of the travelling wave at the frequency of operation.

Ground plane 202 is separated from interstitial conductor 203 via a spacer 204. In one embodiment, spacer 204 is a foam or air-like spacer. In one embodiment, spacer 204 comprises a plastic spacer.

Figure 5:
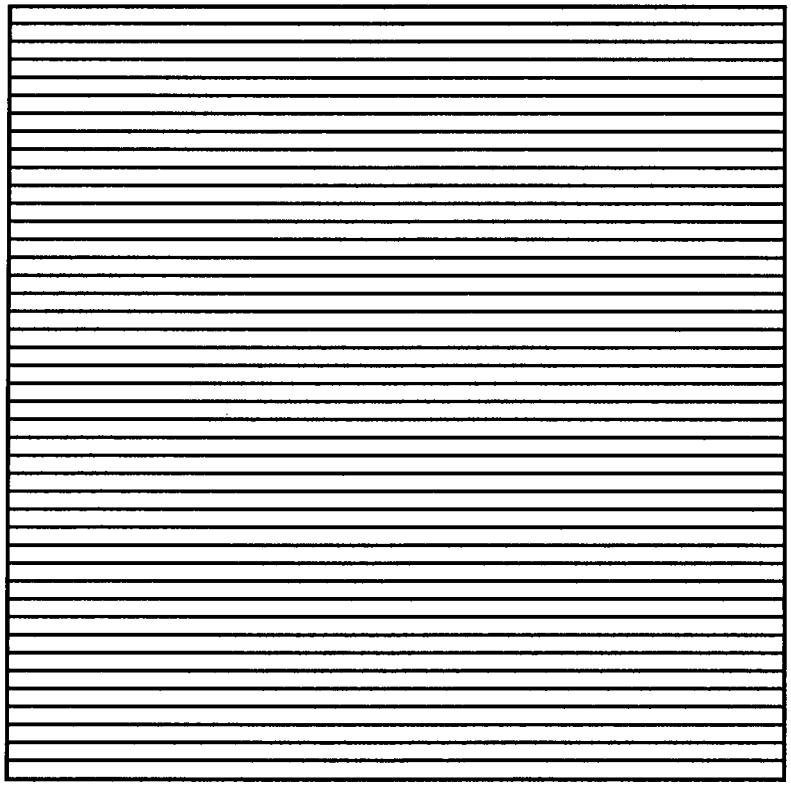
FIG. 5 illustrates an example of a dielectric material into which a feed wave is launched.

On top of interstitial conductor 203 is dielectric layer 205. In one embodiment, dielectric layer 205 is plastic. FIG. 5 illustrates an example of a dielectric material into which a feed wave is launched. The purpose of dielectric layer 205 is to slow the travelling wave relative to free space velocity. In one embodiment, dielectric layer 205 slows the travelling wave by 30% relative to free space. In one embodiment, the range of indices of refraction that are suitable for beam forming are 1.2-1.8, where free space has by definition an index of refraction equal to 1. Other dielectric spacer materials, such as, for example, plastic, may be used to achieve this effect. Note that materials other than plastic may be used as long as they achieve the desired wave slowing effect. Alternatively, a material with distributed structures may be used as dielectric 205, such as periodic sub-wavelength metallic structures that can be machined or lithographically defined, for example.

An RF-array 206 is on top of dielectric 205. In one embodiment, the distance between interstitial conductor 203 and RF-array 206 is 0.1-0.15". In another embodiment, this distance may be $\lambda_{eff}/2$, where $\lambda_{eff}$ is the effective wavelength in the medium at the design frequency.

Figure 20:
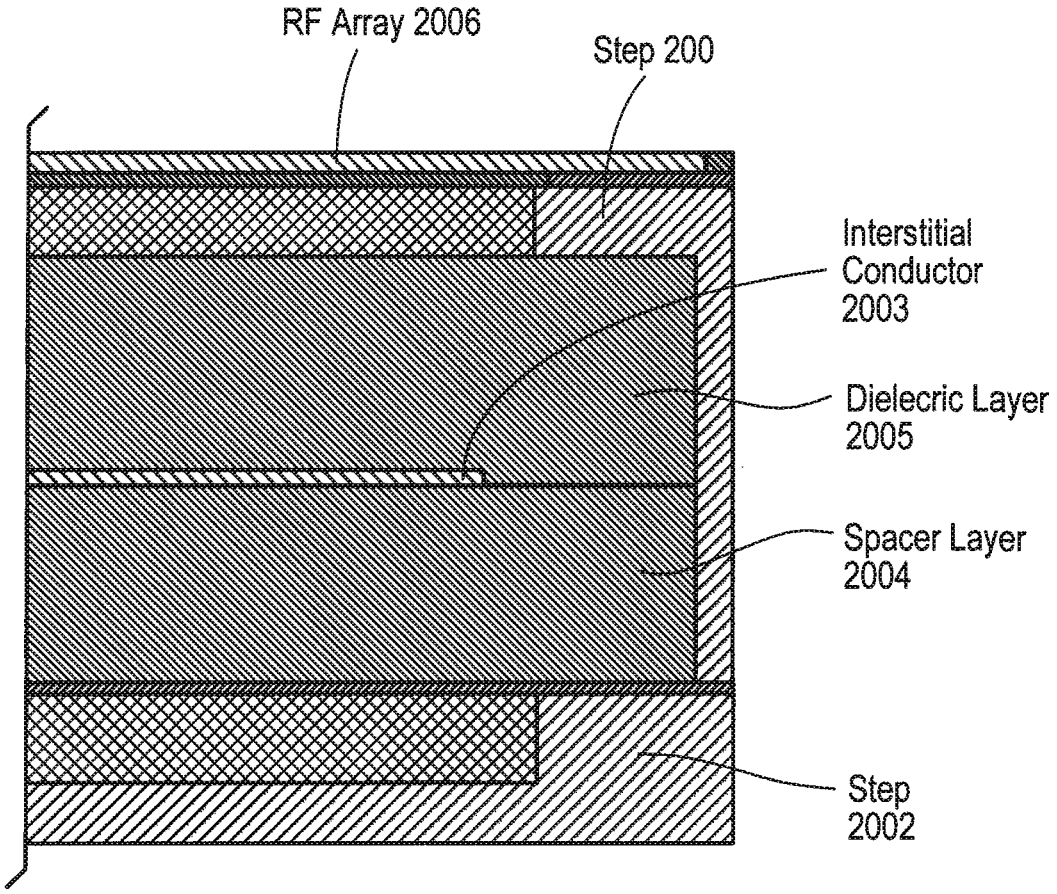
FIG. 20 illustrates an alternative antenna embodiment in which each of the sides include a step to cause a traveling wave to be transmitted from a bottom layer to a top layer.

The antenna includes sides 207 and 208. Sides 207 and 208 are angled to cause a travelling wave feed from coax pin 201 to be propagated from the area below interstitial conductor 203 (the spacer layer) to the area above interstitial conductor 203 (the dielectric layer) via reflection. In one embodiment, the angle of sides 207 and 208 are at 45° angles. In an alternative embodiment, sides 207 and 208 could be replaced with a continuous radius to achieve the reflection. While FIG. 2A shows angled sides that have angle of 45 degrees, other angles that accomplish signal transmission from lower level feed to upper level feed may be used. That is, given that the effective wavelength in the lower feed will generally be different than in the upper feed, some deviation from the ideal 45° angles could be used to aid transmission from the lower to the upper feed level. For example, in another embodiment, the 45° angles are replaced with a single step such as shown in FIG. 20. Referring to FIG. 20, steps 2001 and 2002 are shown on one end of the antenna around dielectric layer 2005, interstitial conductor 2003, and spacer layer 2004. The same two steps are at the other ends of these layers.

In operation, when a feed wave is fed in from coaxial pin 201, the wave travels outward concentrically oriented from coaxial pin 201 in the area between ground plane 202 and interstitial conductor 203. The concentrically outgoing waves are reflected by sides 207 and 208 and travel inwardly in the area between interstitial conductor 203 and RF array 206. The reflection from the edge of the circular perimeter causes the wave to remain in phase (i.e., it is an in-phase reflection). The travelling wave is slowed by dielectric layer 205. At this point, the travelling wave starts interacting and exciting with elements in RF array 206 to obtain the desired scattering.

To terminate the travelling wave, a termination 209 is included in the antenna at the geometric center of the antenna. In one embodiment, termination 209 comprises a pin termination (e.g., a 50Ω pin). In another embodiment, termination 209 comprises an RF absorber that terminates unused energy to prevent reflections of that unused energy back through the feed structure of the antenna. These could be used at the top of RF array 206.

Figure 2B:
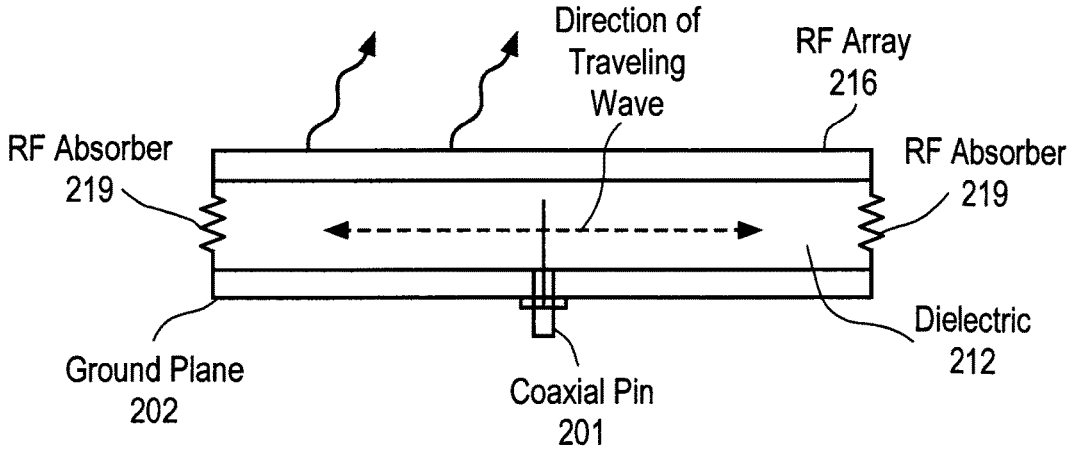

FIG. 2B illustrates another embodiment of the antenna system with an outgoing wave. Referring to FIG. 2B, two ground planes 210 and 211 are substantially parallel to each other with a dielectric layer 212 (e.g., a plastic layer, etc.) in between ground planes 210 and 211. RF absorbers 213 and 214 (e.g., resistors) couple the two ground planes 210 and 211 together. A coaxial pin 215 (e.g., 50Ω) feeds the antenna. An RF array 216 is on top of dielectric layer 212.

In operation, a feed wave is fed through coaxial pin 215 and travels concentrically outward and interacts with the elements of RF array 216.

The cylindrical feed in both the antennas of FIGS. 2A and 2B improves the service angle of the antenna. Instead of a service angle of plus or minus forty five degrees azimuth (±45° Az) and plus or minus twenty five degrees elevation (±25° El), in one embodiment, the antenna system has a service angle of seventy five degrees (75°) from the bore sight in all directions. As with any beam forming antenna comprised of many individual radiators, the overall antenna gain is dependent on the gain of the constituent elements, which themselves are angle-dependent. When using common radiating elements, the overall antenna gain typically decreases as the beam is pointed further off bore sight. At 75 degrees off bore sight, significant gain degradation of about 6 dB is expected.

Embodiments of the antenna having a cylindrical feed solve one or more problems. These include dramatically simplifying the feed structure compared to antennas fed with a corporate divider network and therefore reducing total required antenna and antenna feed volume; decreasing sensitivity to manufacturing and control errors by maintaining high beam performance with coarser controls (extending all the way to simple binary control); giving a more advantageous side lobe pattern compared to rectilinear feeds because the cylindrically oriented feed waves result in spatially diverse side lobes in the far field; and allowing polarization to be dynamic, including allowing left-hand circular, right-hand circular, and linear polarizations, while not requiring a polarizer.

Array of Wave Scattering Elements

RF array 206 of FIG. 2A and RF array 216 of FIG. 2B include a wave scattering subsystem that includes a group of patch antennas (i.e., scatterers) that act as radiators. This group of patch antennas comprises an array of scattering metamaterial elements.

In one embodiment, each scattering element in the antenna system is part of a unit cell that consists of a lower conductor, a dielectric substrate and an upper conductor that embeds a complementary electric inductive-capacitive resonator ("complementary electric LC" or "CELC") that is etched in or deposited onto the upper conductor.

In one embodiment, a liquid crystal (LC) is injected in the gap around the scattering element. Liquid crystal is encapsulated in each unit cell and separates the lower conductor associated with a slot from an upper conductor associated with its patch. Liquid crystal has a permittivity that is a function of the orientation of the molecules comprising the liquid crystal, and the orientation of the molecules (and thus the permittivity) can be controlled by adjusting the bias voltage across the liquid crystal. Using this property, the liquid crystal acts as an on/off switch for the transmission of energy from the guided wave to the CELC. When switched on, the CELC emits an electromagnetic wave like an electrically small dipole antenna.

Controlling the thickness of the LC increases the beam switching speed. A fifty percent (50%) reduction in the gap between the lower and the upper conductor (the thickness of the liquid crystal) results in a fourfold increase in speed. In another embodiment, the thickness of the liquid crystal results in a beam switching speed of approximately fourteen milliseconds (14 ms). In one embodiment, the LC is doped in a manner well-known in the art to improve responsiveness so that a seven millisecond (7 ms) requirement can be met.

The CELC element is responsive to a magnetic field that is applied parallel to the plane of the CELC element and perpendicular to the CELC gap complement. When a voltage is applied to the liquid crystal in the metamaterial scattering unit cell, the magnetic field component of the guided wave induces a magnetic excitation of the CELC, which, in turn, produces an electromagnetic wave in the same frequency as the guided wave.

The phase of the electromagnetic wave generated by a single CELC can be selected by the position of the CELC on the vector of the guided wave. Each cell generates a wave in phase with the guided wave parallel to the CELC. Because the CELCs are smaller than the wave length, the output wave has the same phase as the phase of the guided wave as it passes beneath the CELC.

In one embodiment, the cylindrical feed geometry of this antenna system allows the CELC elements to be positioned at forty five degree (45°) angles to the vector of the wave in the wave feed. This position of the elements enables control of the polarization of the free space wave generated from or received by the elements. In one embodiment, the CELCs are arranged with an inter-element spacing that is less than a free-space wavelength of the operating frequency of the antenna. For example, if there are four scattering elements per wavelength, the elements in the 30 GHz transmit antenna will be approximately 2.5 mm (i.e., ¼th the 10 mm free-space wavelength of 30 GHz).

In one embodiment, the CELCs are implemented with patch antennas that include a patch co-located over a slot with liquid crystal between the two. In this respect, the metamaterial antenna acts like a slotted (scattering) wave guide. With a slotted wave guide, the phase of the output wave depends on the location of the slot in relation to the guided wave.

Figure 3:
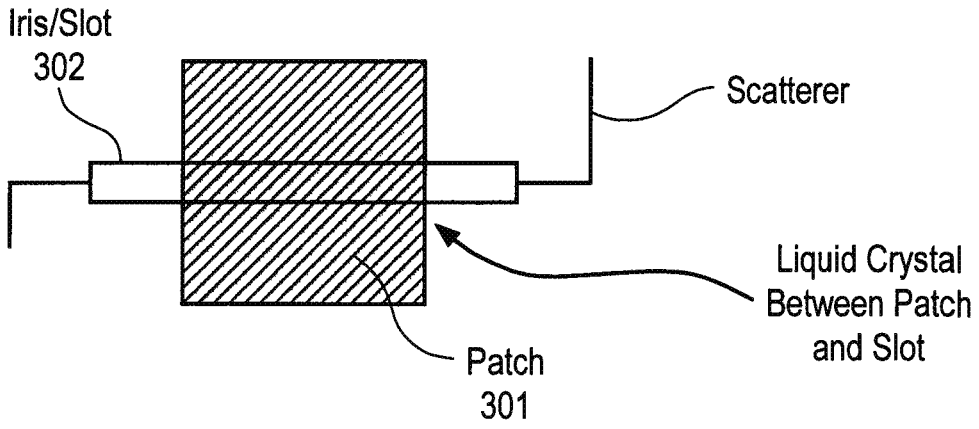
FIG. 3 illustrates a top view of one embodiment of one slot-coupled patch antenna, or scatterer.

FIG. 3 illustrates a top view of one embodiment of one patch antenna, or scattering element. Referring to FIG. 3, the patch antenna comprises a patch 301 collocated over a slot 302 with liquid crystal (LC) 303 in between patch 301 and slot 302.

Figure 4:
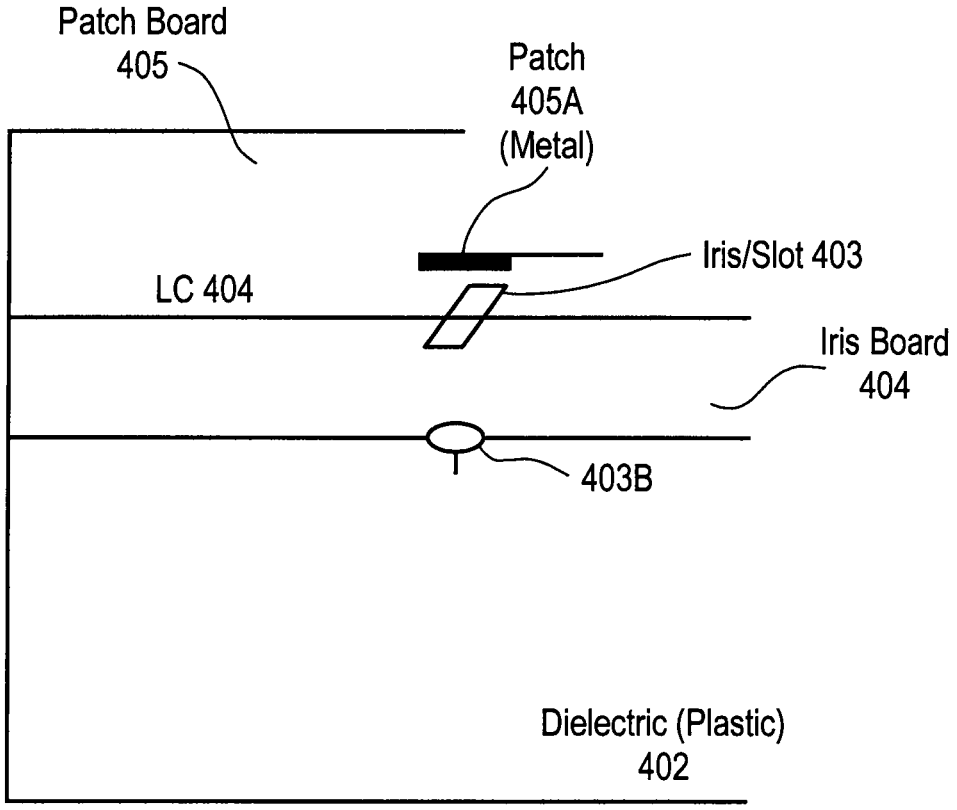
FIG. 4 illustrates a side view of a slot-fed patch antenna that is part of a cyclically fed antenna system.

FIG. 4 illustrates a side view of a patch antenna that is part of a cyclically fed antenna system. Referring to FIG. 4, the patch antenna is above dielectric 402 (e.g., a plastic insert, etc.) that is above the interstitial conductor 203 of FIG. 2A (or a ground conductor such as in the case of the antenna in FIG. 2B).

An iris board 403 is a ground plane (conductor) with a number of slots, such as slot 403*a* on top of and over dielectric 402. A slot may be referred to herein as an iris. In one embodiment, the slots in iris board 403 are created by etching. Note that in one embodiment, the highest density of slots, or the cells of which they are a part, is λ/2. In one embodiment, the density of slots/cells is λ/3 (i.e., 3 cells per λ). Note that other densities of cells may be used.

A patch board 405 containing a number of patches, such as patch 405*a*, is located over the iris board 403, separated by an intermediate dielectric layer. Each of the patches, such as patch 405*a*, are co-located with one of the slots in iris board 403. In one embodiment, the intermediate dielectric layer between iris board 403 and patch board 405 is a liquid crystal substrate layer 404. The liquid crystal acts as a dielectric layer between each patch and its co-located slot. Note that substrate layers other than LC may be used.

In one embodiment, patch board 405 comprises a printed circuit board (PCB), and each patch comprises metal on the PCB, where the metal around the patch has been removed.

In one embodiment, patch board 405 includes vias for each patch that is on the side of the patch board opposite the side where the patch faces its co-located slot. The vias are used to connect one or more traces to a patch to provide voltage to the patch. In one embodiment, matrix drive is used to apply voltage to the patches to control them. The voltage is used to tune or detune individual elements to effectuate beam forming.

Figure 17:
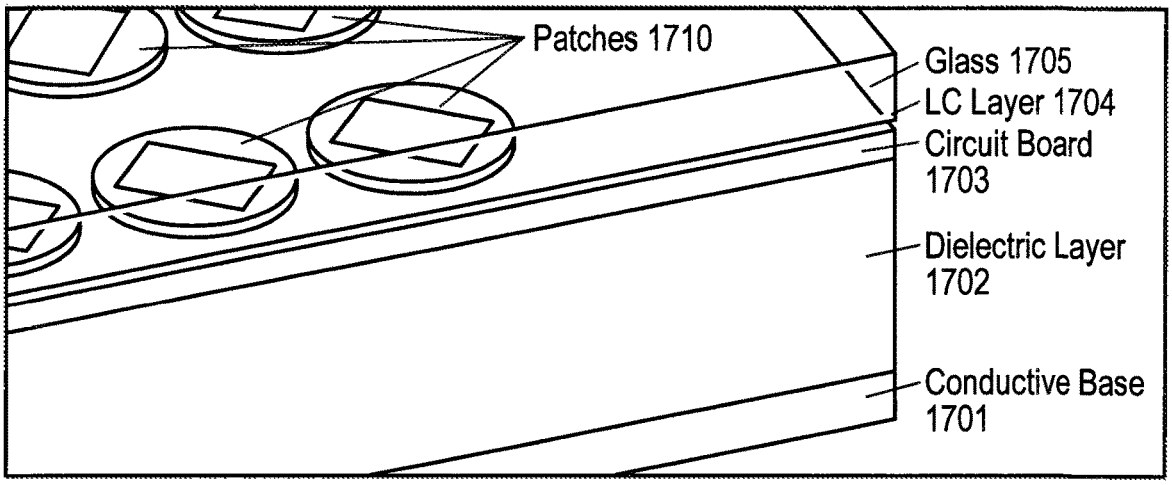
FIG. 17 illustrates a portion of a cylindrically fed antenna that includes a glass layer that contains the patches.

In one embodiment, the patches may be deposited on the glass layer (e.g., a glass typically used for LC displays (LCDs) such as, for example, Corning Eagle glass), instead of using a circuit patch board. FIG. 17 illustrates a portion of a cylindrically fed antenna that includes a glass layer that contains the patches. Referring to FIG. 17, the antenna includes conductive base or ground layer 1701, dielectric layer 1702 (e.g., plastic), iris board 1703 (e.g., a circuit board) containing slots, a liquid crystal substrate layer 1704, and a glass layer 1705 containing patches 1710. In one embodiment, the patches 1710 have a rectangular shape. In one embodiment, the slots and patches are positioned in rows and columns, and the orientation of patches is the same for each row or column while the orientation of the co-located slots are oriented the same with respect to each other for rows or columns, respectively.

In one embodiment, a cap (e.g., a radome cap) covers the top of the patch antenna stack to provide protection.

Figure 6:
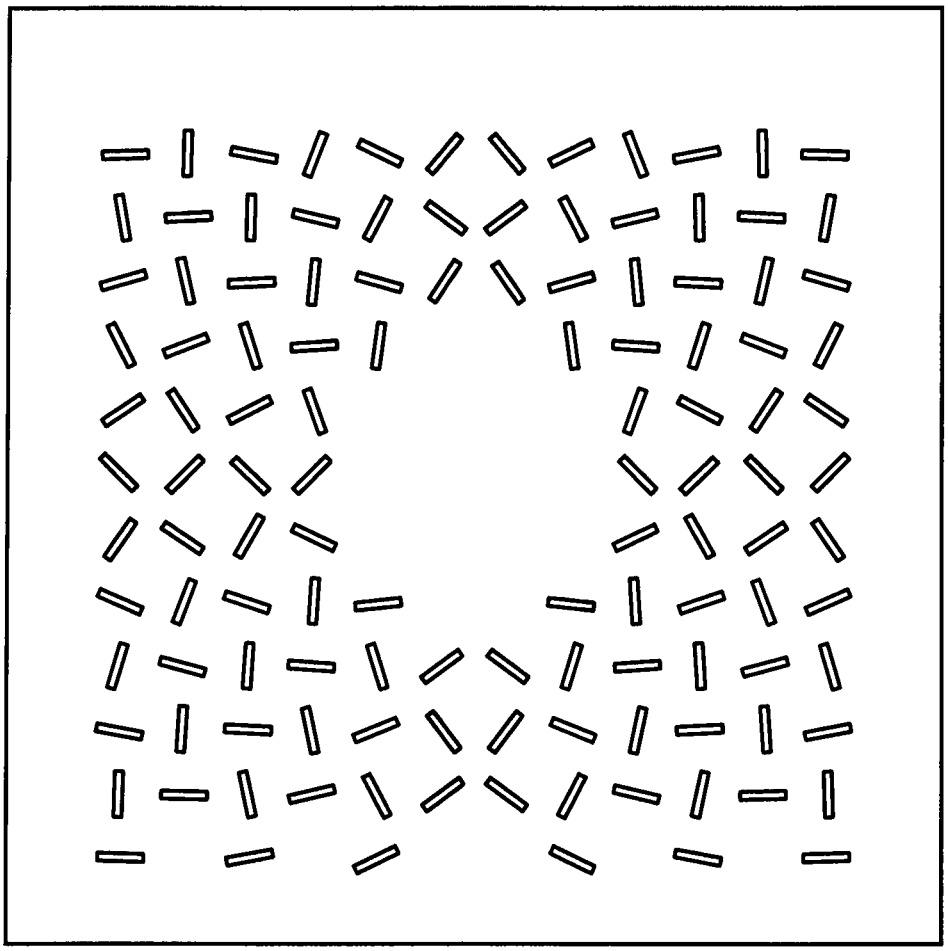
FIG. 6 illustrates one embodiment of an iris board showing slots and their orientation.

FIG. 6 illustrates one embodiment of iris board 403. This is a lower conductor of the CELCs. Referring to FIG. 6, the iris board includes an array of slots. In one embodiment, each slot is oriented either +45 or −45 relative to the impinging feed wave at the slot's central location. In other words, the layout pattern of the scattering elements (CELCs) are arranged at ±45 degrees to the vector of the wave. Below each slot is a circular opening 403*b*, which is essentially another slot. The slot is on the top of the Iris board and the circular or elliptical opening is on the bottom of the Iris board. Note that these openings, which may be about 0.001" or 25 mm in depth, are optional.

The slotted array is tunably directionally loaded. By turning individual slots off or on, each slot is tuned to provide the desired scattering at the operating frequency of the antenna (i.e., it is tuned to operate at a given frequency).

Figure 7:
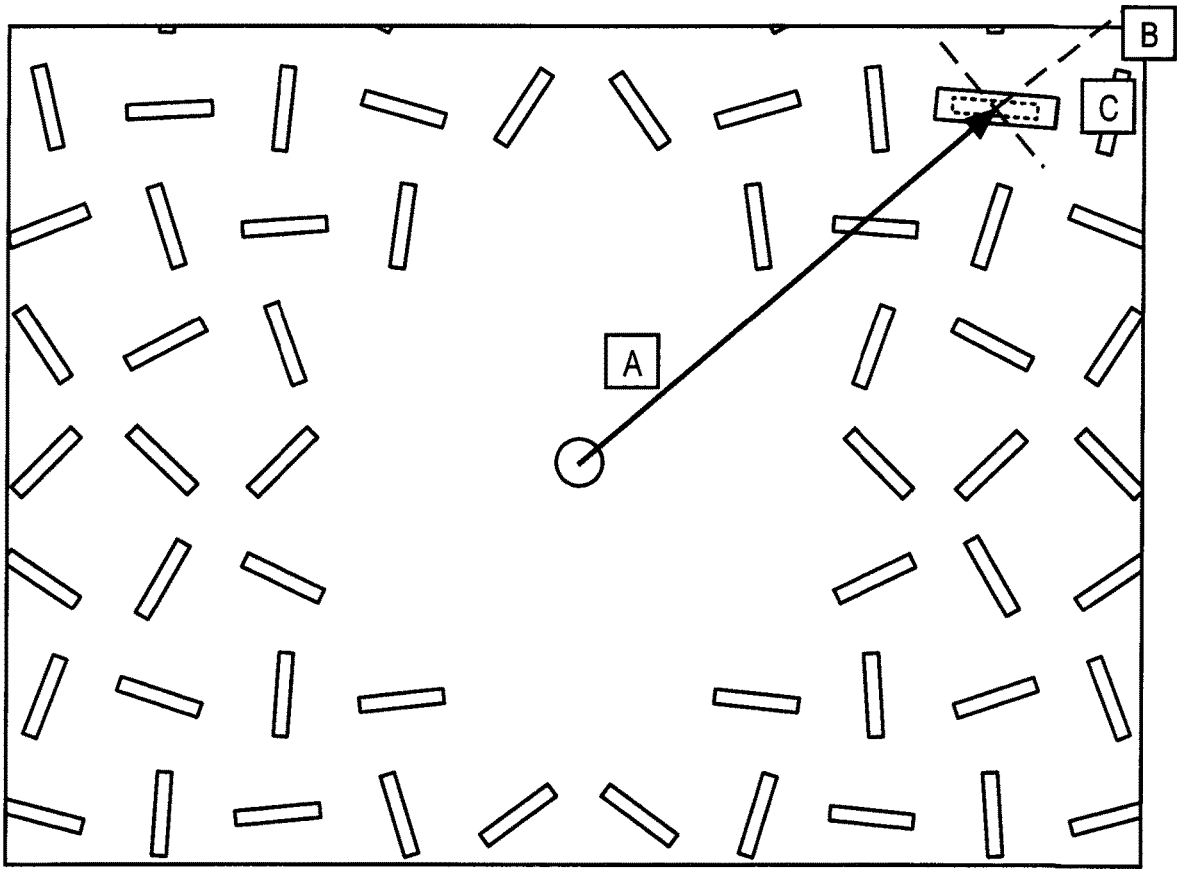
FIG. 7 illustrates the manner in which the orientation of one iris/patch combination is determined.

FIG. 7 illustrates the manner in which the orientation of one iris (slot)/patch combination is determined. Referring to FIG. 7, the letter A denotes a solid black arrow denoting power feed vector from a cylindrical feed location to the center of an element. The letter B denotes dashed orthogonal lines showing perpendicular axes relative to "A", and the letter C denotes a dashed rectangle encircling slot rotated 45 degrees relative to "B".

Figure 8:
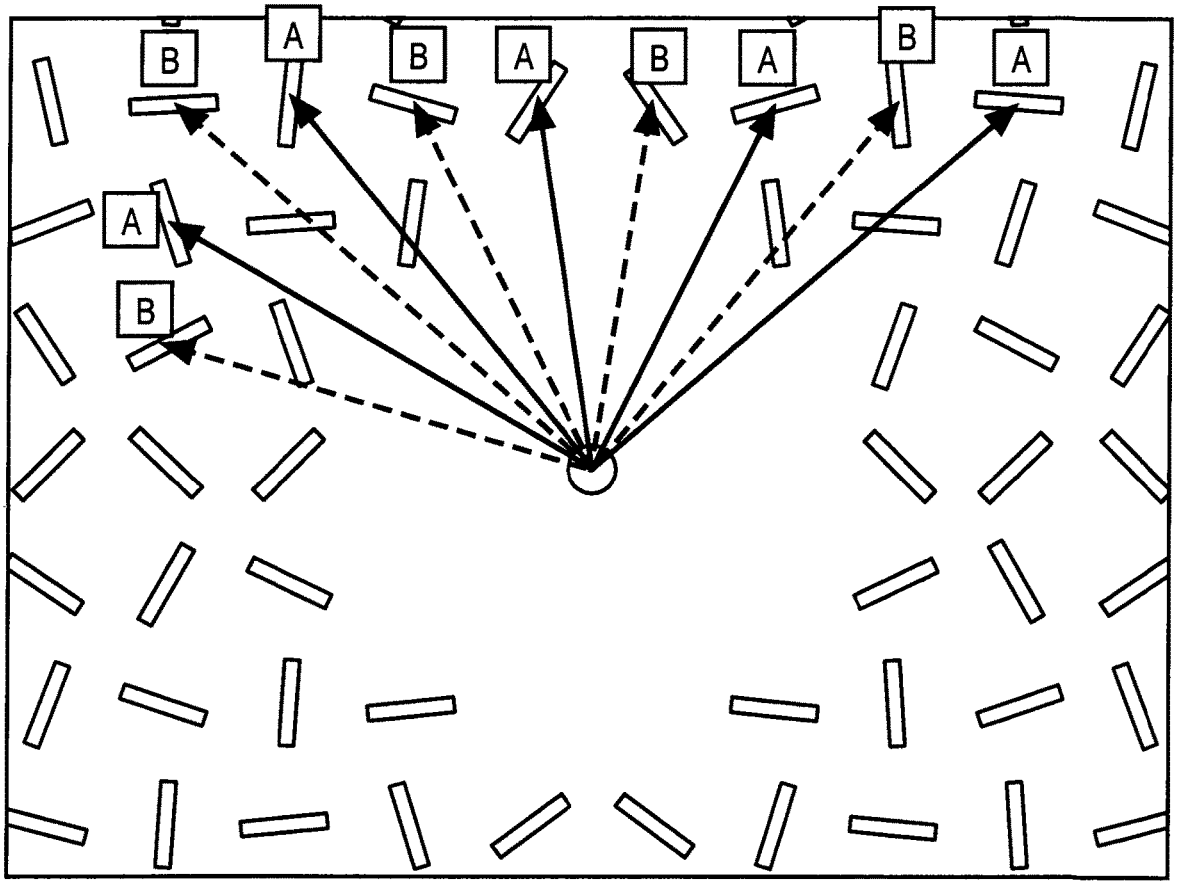
FIG. 8 illustrates irises grouped into two sets, with the first set rotated at −45 degrees relative to the power feed vector and the second set rotated +45 degrees relative to the power feed vector.

FIG. 8 illustrates irises (slots) grouped into two sets, with the first set rotated at −45 degrees relative to the power feed vector and the second set rotated +45 degrees relative to the power feed vector. Referring to FIG. 8, group A includes slots whose rotation relative to a feed vector is equal to −45°, while group B includes slots whose rotation relative to a feed vector is +45°.

Note that the designation of a global coordinate system is unimportant, and thus rotations of negative and positive angles are important only because they describe relative rotations of elements to each other and to the feed wave direction. To generate circular polarization from two sets of linearly polarized elements, the two sets of elements are perpendicular to each other and simultaneously have equal amplitude excitation. Rotating them +/−45 degrees relative to the feed wave excitation achieves both desired features at once. Rotating one set 0 degrees and the other 90 degrees would achieve the perpendicular goal, but not the equal amplitude excitation goal.

Figure 9:
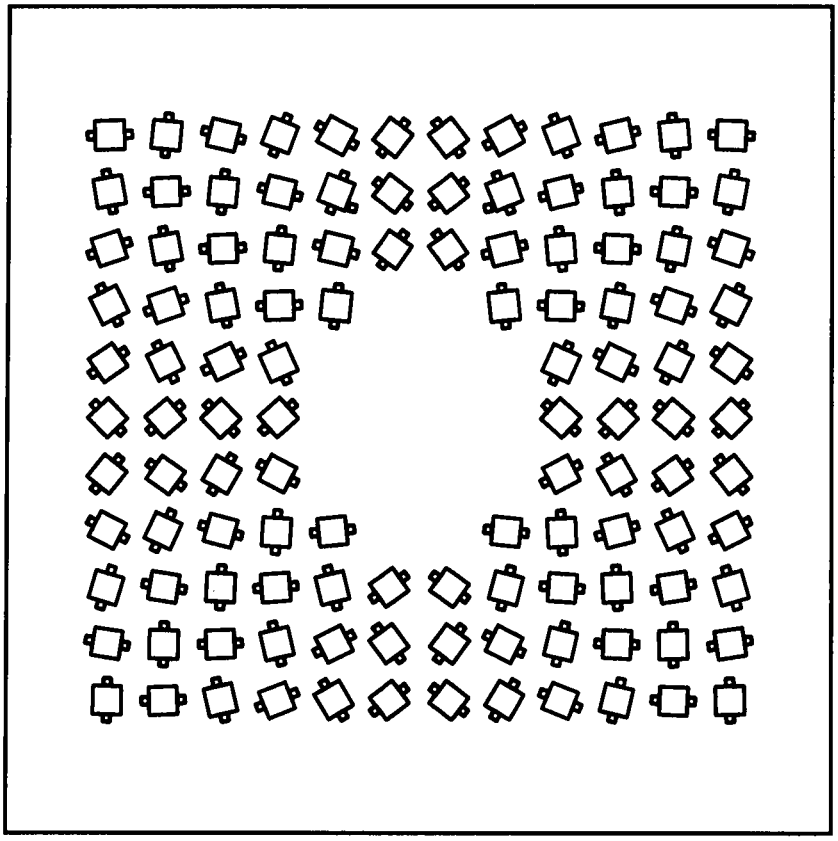
FIG. 9 illustrates an embodiment of a patch board.

FIG. 9 illustrates an embodiment of patch board 405. This is an upper conductor of the CELCs. Referring to FIG. 9, the patch board includes rectangular patches covering slots and completing linearly polarized patch/slot resonant pairs to be turned off and on. The pairs are turned off or on by applying a voltage to the patch using a controller. The voltage required is dependent on the liquid crystal mixture being used, the resulting threshold voltage required to begin to tune the liquid crystal, and the maximum saturation voltage (beyond which no higher voltage produces any effect except to eventually degrade or short circuit through the liquid crystal). In one embodiment, matrix drive is used to apply voltage to the patches in order to control the coupling.

Antenna System Control

The control structure has 2 main components; the controller, which includes drive electronics, for the antenna system, is below the wave scattering structure, while the matrix drive switching array is interspersed throughout the radiating RF array in such a way as to not interfere with the radiation. In one embodiment, the drive electronics for the antenna system comprise commercial off-the shelf LCD controls used in commercial television appliances that adjust the bias voltage for each scattering element by adjusting the amplitude of an AC bias signal to that element.

In one embodiment, the controller controls the electronics using software controls. In one embodiment, the control of the polarization is part of the software control of the antenna and the polarization is pre-programmed to match the polarization of the signal coming from the satellite service with which the earth station is communicating or be pre-programmed to match the polarization of the receiving antenna on the satellite.

In one embodiment, the controller also contains a microprocessor executing the software. The control structure may also incorporate sensors (nominally including a GPS receiver, a three axis compass and an accelerometer) to provide location and orientation information to the processor. The location and orientation information may be provided to the processor by other systems in the earth station and/or may not be part of the antenna system.

More specifically, the controller controls which elements are turned off and those elements turned on at the frequency of operation. The elements are selectively detuned for frequency operation by voltage application. A controller supplies an array of voltage signals to the RF radiating patches to create a modulation, or control pattern. The control pattern causes the elements to be turned on or off. In one embodiment, the control pattern resembles a square wave in which elements along one spiral (LHCP or RHCP) are "on" and those elements away from the spiral are "off" (i.e., a binary modulation pattern). In another embodiment, multistate control is used in which various elements are turned on and off to varying levels, further approximating a sinusoidal control pattern, as opposed to a square wave (i.e., a sinusoid gray shade modulation pattern). Some elements radiate more strongly than others, rather than some elements radiate and some do not. Variable radiation is achieved by applying specific voltage levels, which adjusts the liquid crystal permittivity to varying amounts, thereby detuning elements variably and causing some elements to radiate more than others.

The generation of a focused beam by the metamaterial array of elements can be explained by the phenomenon of constructive and destructive interference. Individual electromagnetic waves sum up (constructive interference) if they have the same phase when they meet in free space and waves cancel each other (destructive interference) if they are in opposite phase when they meet in free space. If the slots in a slotted antenna are positioned so that each successive slot is positioned at a different distance from the excitation point of the guided wave, the scattered wave from that element will have a different phase than the scattered wave of the previous slot. If the slots are spaced one quarter of a guided wavelength apart, each slot will scatter a wave with a one fourth phase delay from the previous slot.

Using the array, the number of patterns of constructive and destructive interference that can be produced can be increased so that beams can be pointed theoretically in any direction plus or minus ninety degrees (90°) from the bore sight of the antenna array, using the principles of holography. Thus, by controlling which metamaterial unit cells are turned on or off (i.e., by changing the pattern of which cells are turned on and which cells are turned off), a different pattern of constructive and destructive interference can be produced, and the antenna can change the direction of the wave front. The time required to turn the unit cells on and off dictates the speed at which the beam can be switched from one location to another location.

Figure 16A:
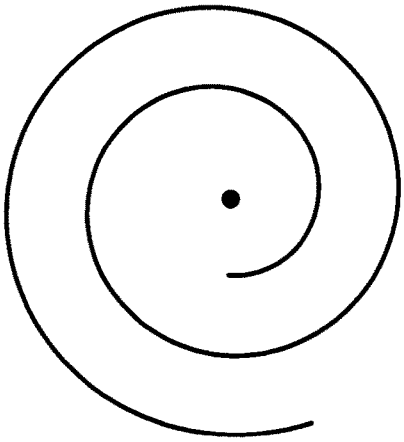
FIGS. 16A and 16B illustrate right-hand circular polarization and left-hand circular polarization, respectively.
Figure 16B:
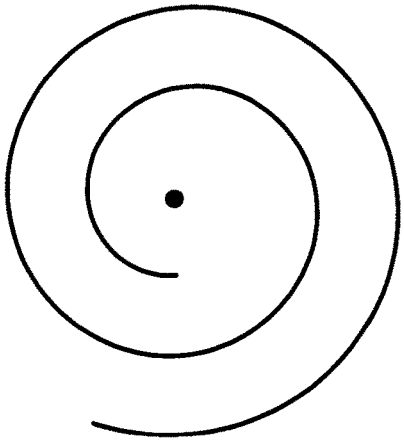

The polarization and beam pointing angle are both defined by the modulation, or control pattern specifying which elements are on or off. In other words, the frequency at which to point the beam and polarize it in the desired way are dependent upon the control pattern. Since the control pattern is programmable, the polarization can be programmed for the antenna system. The desired polarization states are circular or linear for most applications. The circular polarization states include spiral polarization states, namely right-hand circular polarization and left-hand circular polarization, which are shown in FIGS. 16A and 16B, respectively, for a feed wave fed from the center and travelling outwardly. Note that to get the same beam while switching feed directions (e.g., going from an ingoing feed to an outgoing feed), the orientation, or sense, or the spiral modulation pattern is reversed. Note that the direction of the feed wave (i.e. center or edge fed) is also specified when stating that a given spiral pattern of on and off elements to result in left-hand or right-hand circular polarization.

The control pattern for each beam will be stored in the controller or calculated on the fly, or some combination thereof. When the antenna control system determines where the antenna is located and where it is pointing, it then determines where the target satellite is located in reference to the bore sight of the antenna. The controller then commands an on and off pattern of the individual unit cells in the array that corresponds with the preselected beam pattern for the position of the satellite in the field of vision of the antenna.

In one embodiment, the antenna system produces one steerable beam for the uplink antenna and one steerable beam for the downlink antenna.

Figure 10:
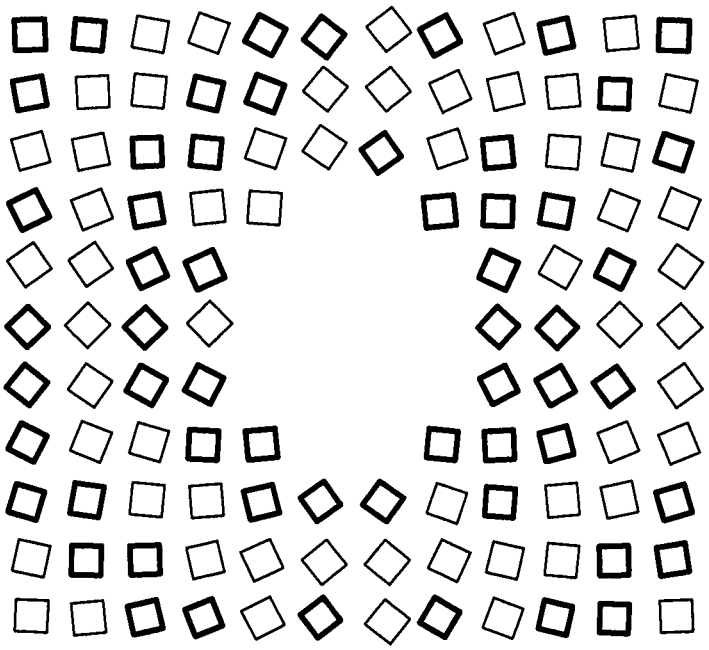
FIG. 10 illustrates an example of elements with patches in FIG. 9 that are determined to be off at frequency of operation.
Figure 11:
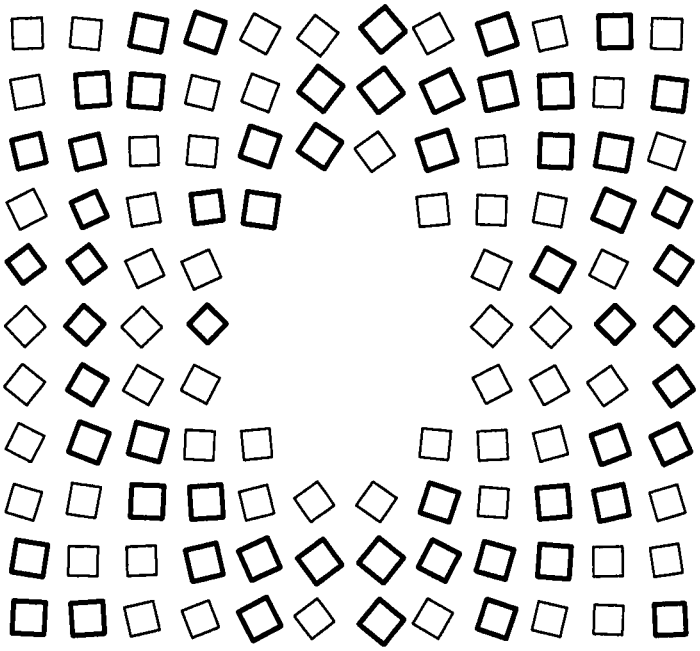
FIG. 11 illustrates an example of elements with patches in FIG. 9 that are determined to be on at frequency of operation.
Figure 12:
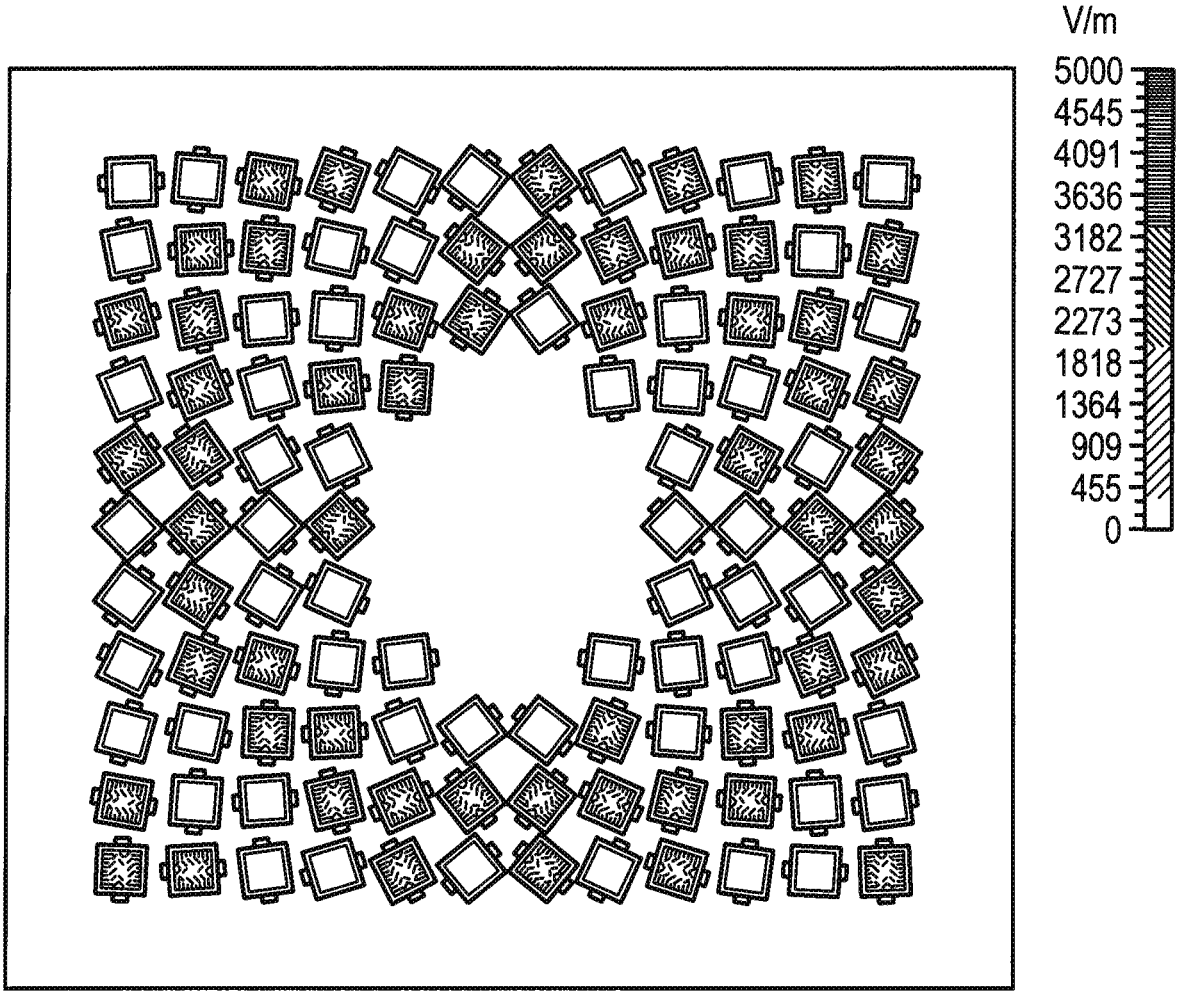
FIG. 12 illustrates the results of full wave modeling that show an electric field response to an on and off control/modulation pattern with respect to the elements of FIGS. 10 and 11.

FIG. 10 illustrates an example of elements with patches in FIG. 9 that are determined to be off at frequency of operation, and FIG. 11 illustrates an example of elements with patches in FIG. 9 that are determined to be on at frequency of operation. FIG. 12 illustrates the results of full wave modeling that show an electric field response to the on and off modulation pattern with respect to the elements of FIGS. 10 and 11.

Figure 13:
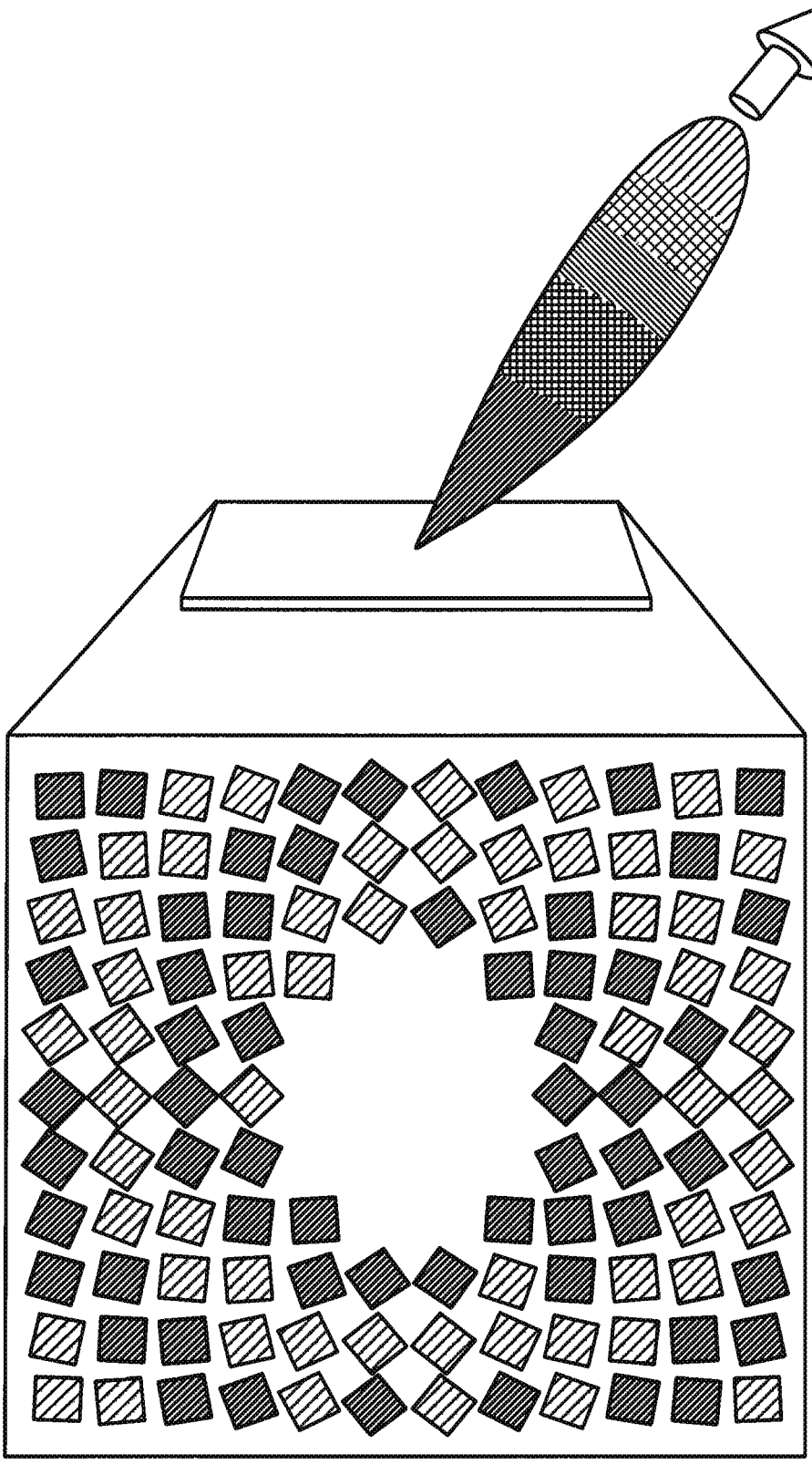
FIG. 13 illustrates beam forming using an embodiment of a cylindrically fed antenna.

FIG. 13 illustrates beam forming. Referring to FIG. 13, the interference pattern may be adjusted to provide arbitrary antenna radiation patterns by identifying an interference pattern corresponding to a selected beam pattern and then adjusting the voltage across the scattering elements to produce a beam according the principles of holography. The basic principle of holography, including the terms "object beam" and "reference beam", as commonly used in connection with these principles, is well-known. RF holography in the context of forming a desired "object beam" using a traveling wave as a "reference beam" is performed as follows.

Figure 19A:
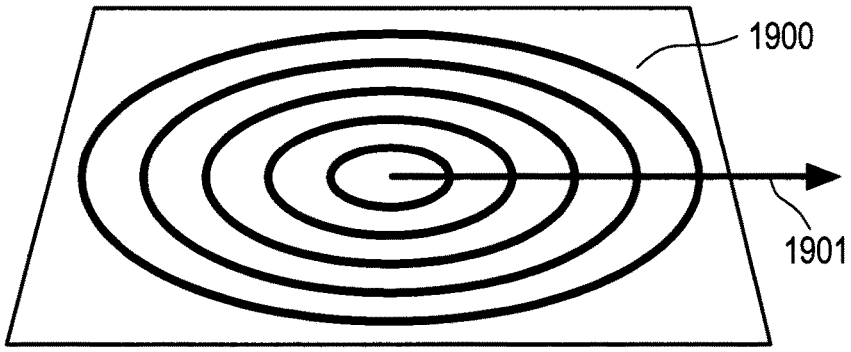
FIG. 19A illustrates an example of a reference wave.

The modulation pattern is determined as follows. First, a reference wave (beam), sometimes called the feed wave, is generated. FIG. 19A illustrates an example of a reference wave. Referring to FIG. 19A, rings 1900 are the phase fronts of the electric and magnetic fields of a reference wave. They exhibit sinusoidal time variation. Arrow 1901 illustrates the outward propagation of the reference wave.

In this example, a TEM, or Transverse Electro-Magnetic, wave travels either inward or outward. The direction of propagation is also defined and for this example outward propagation from a center feed point is chosen. The plane of propagation is along the antenna surface.

Figure 19B:
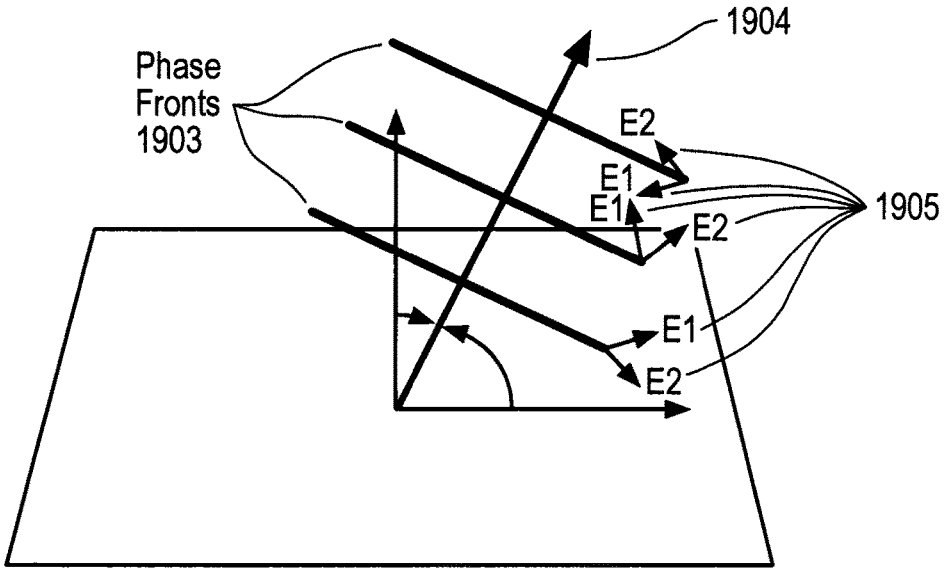
FIG. 19B illustrates a generated object wave.

An object wave, sometimes called the object beam, is generated. In this example, the object wave is a TEM wave travelling in direction 30 degrees off normal to the antenna surface, with azimuth set to 0 deg. The polarization is also defined and for this example right handed circular polarization is chosen. FIG. 19B illustrates a generated object wave. Referring to FIG. 19B, phase fronts 1903 of the electric and magnetic fields of the propagating TEM wave 1904 are shown. Arrows 1905 are the electric field vectors at each phase front, represented at 90 degree intervals. In this example, they adhere to the right hand circular polarization choice.

$$\text{Interference or modulation pattern}=\mathrm{Re}\{[A]\times[B]^*\}$$

Figure 19C:
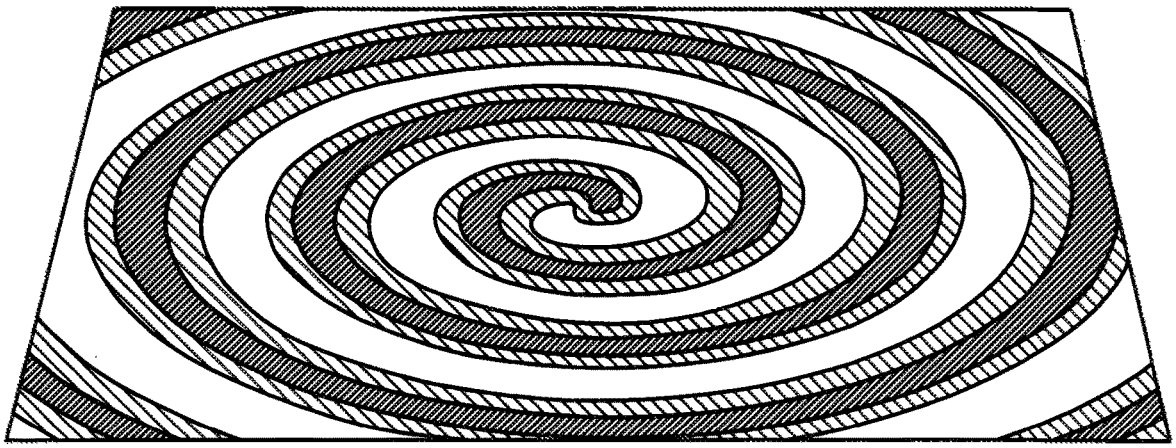
FIG. 19C is an example of the resulting sinusoidal modulation pattern.

When a sinusoid is multiplied by the complex conjugate of another sinusoid and the real part is taken, the resulting modulation pattern is also a sinusoid. Spatially, where the maxima of the reference wave meets the maxima of the object wave (both sinusoidally time-varying quantities), the modulation pattern is a maxima, or a strongly radiating site. In practice, this interference is calculated at each scattering location and is dependent on not just the position, but also the polarization of the element based on its rotation and the polarization of the object wave at the location of the element. FIG. 19C is an example of the resulting sinusoidal modulation pattern.

Note that a choice can further be made to simplify the resulting sinusoidal gray shade modulation pattern into a square wave modulation pattern.

Note that the voltage across the scattering elements is controlled by adjusting the voltage applied between the patches and the ground plane, which in this context is the metallization on the top of the iris board.

Alternative Embodiments

Figure 14A:
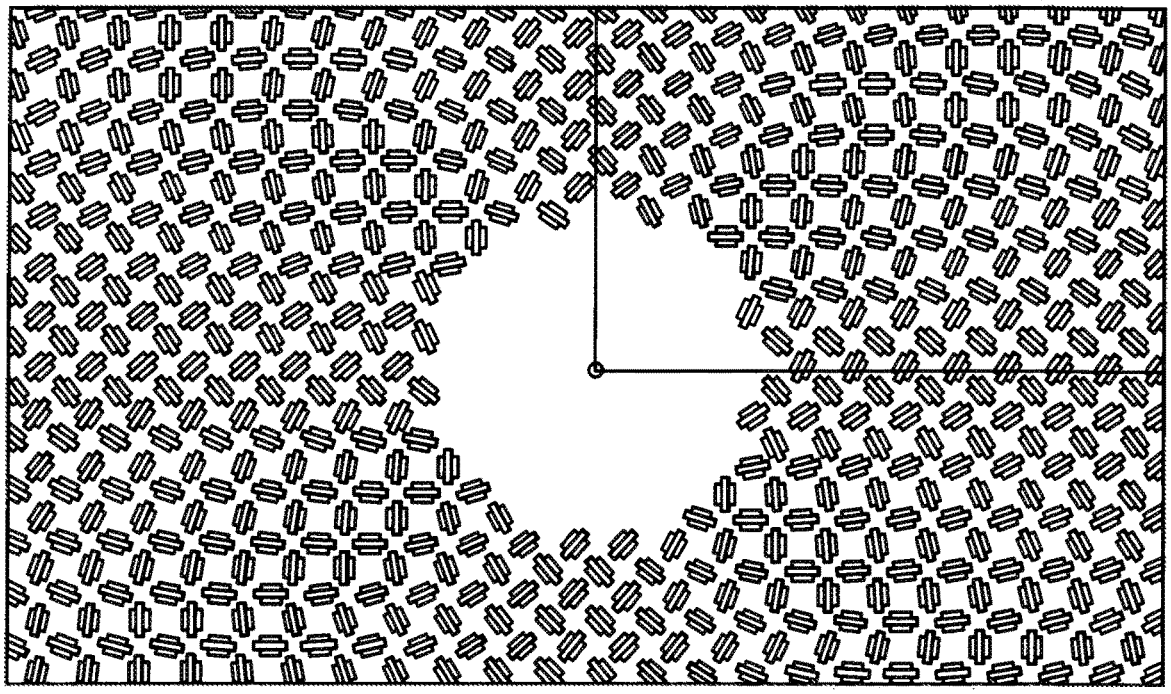
FIGS. 14A and 14B illustrate patches and slots positioned in a honeycomb pattern.
Figure 14B:
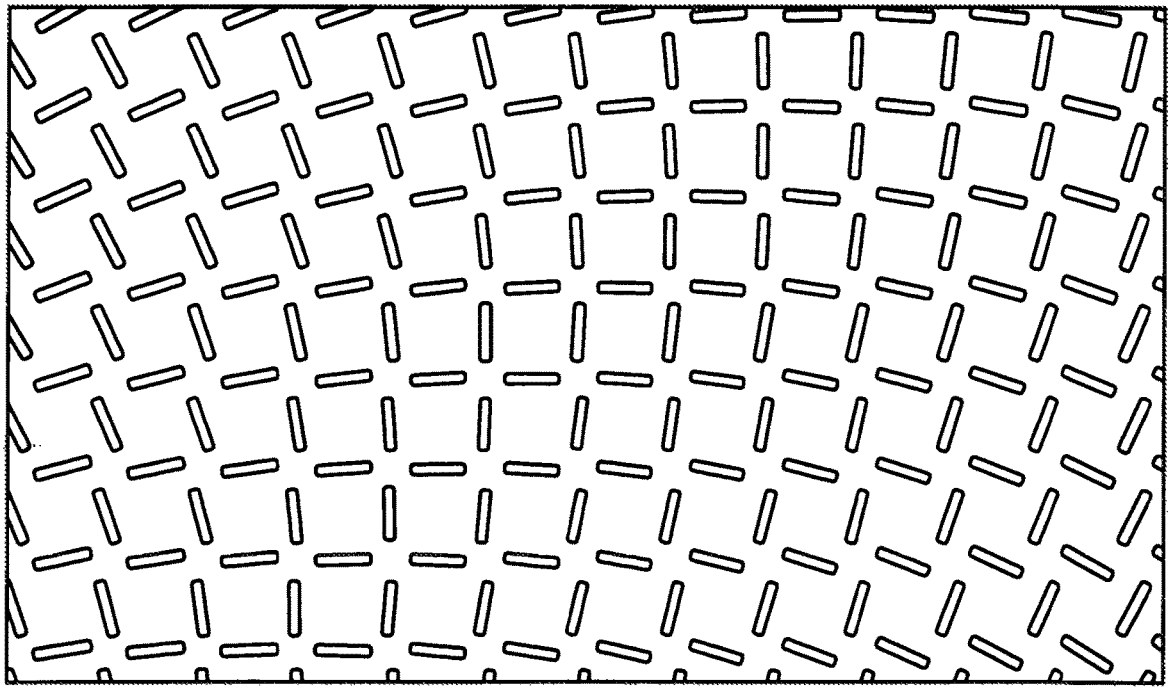

In one embodiment, the patches and slots are positioned in a honeycomb pattern. Examples of such a pattern are shown in FIGS. 14A and 14B. Referring to FIGS. 14A and 14B, honeycomb structures are such that every other row is shifted left or right by one half element spacing or, alternatively, every other column is shifted up or down by one half the element spacing.

Figure 15A:
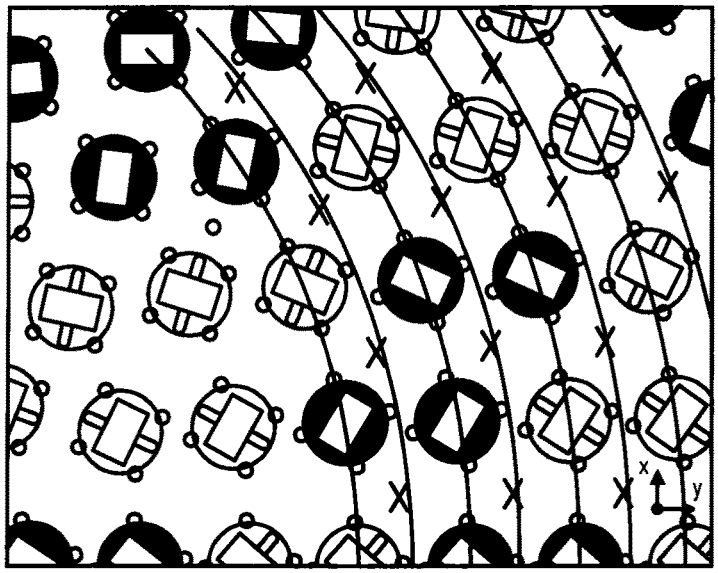
FIGS. 15A-C illustrate patches and associated slots positioned in rings to create a radial layout, an associated control pattern, and resulting antenna response.

In one embodiment, the patches and associated slots are positioned in rings to create a radial layout. In this case, the slot center is positioned on the rings. FIG. 15A illustrates an example of patches (and their co-located slots) being positioned in rings. Referring to FIG. 15A, the centers of the patches and slots are on the rings and the rings are concentrically located relative to the feed or termination point of the antenna array. Note that adjacent slots located in the same ring are oriented almost 90° with respect to each other (when evaluated at their center). More specifically, they are oriented at an angle equal to 90° plus the angular displacement along the ring containing the geometric centers of the 2 elements.

Figure 15B:
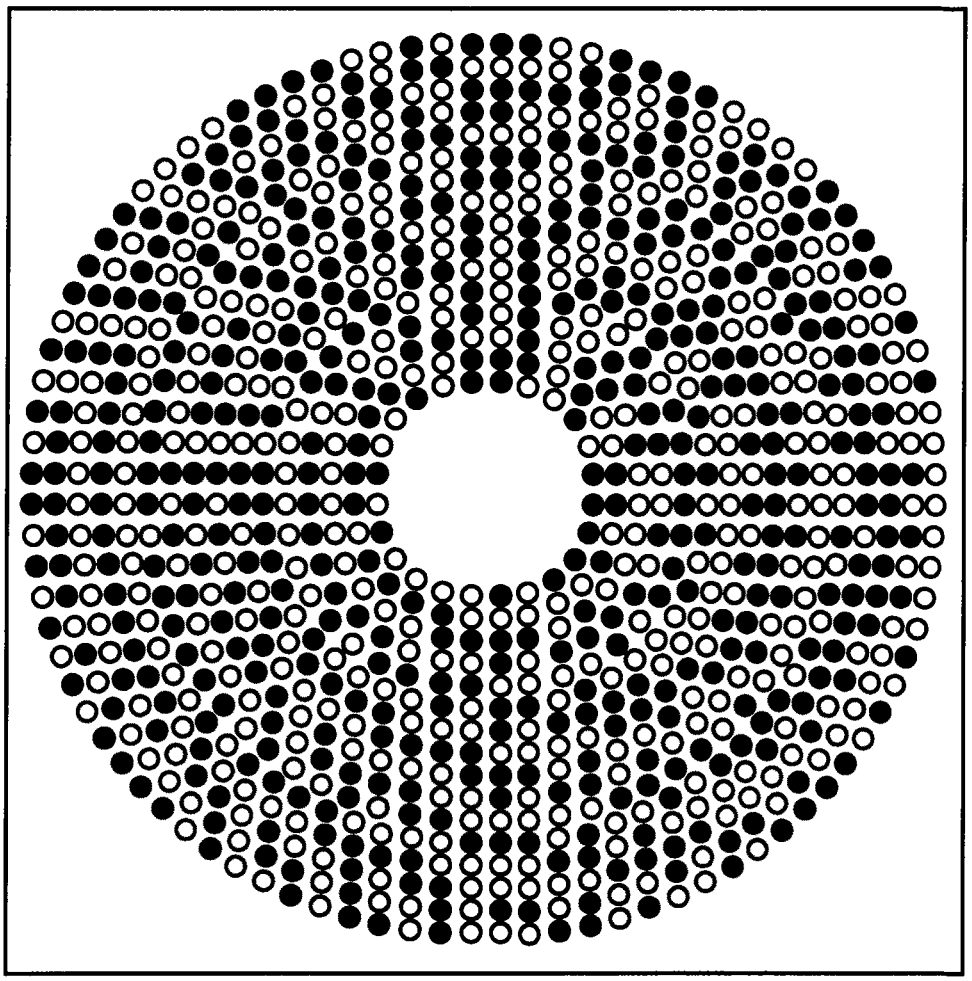
Figure 15C:
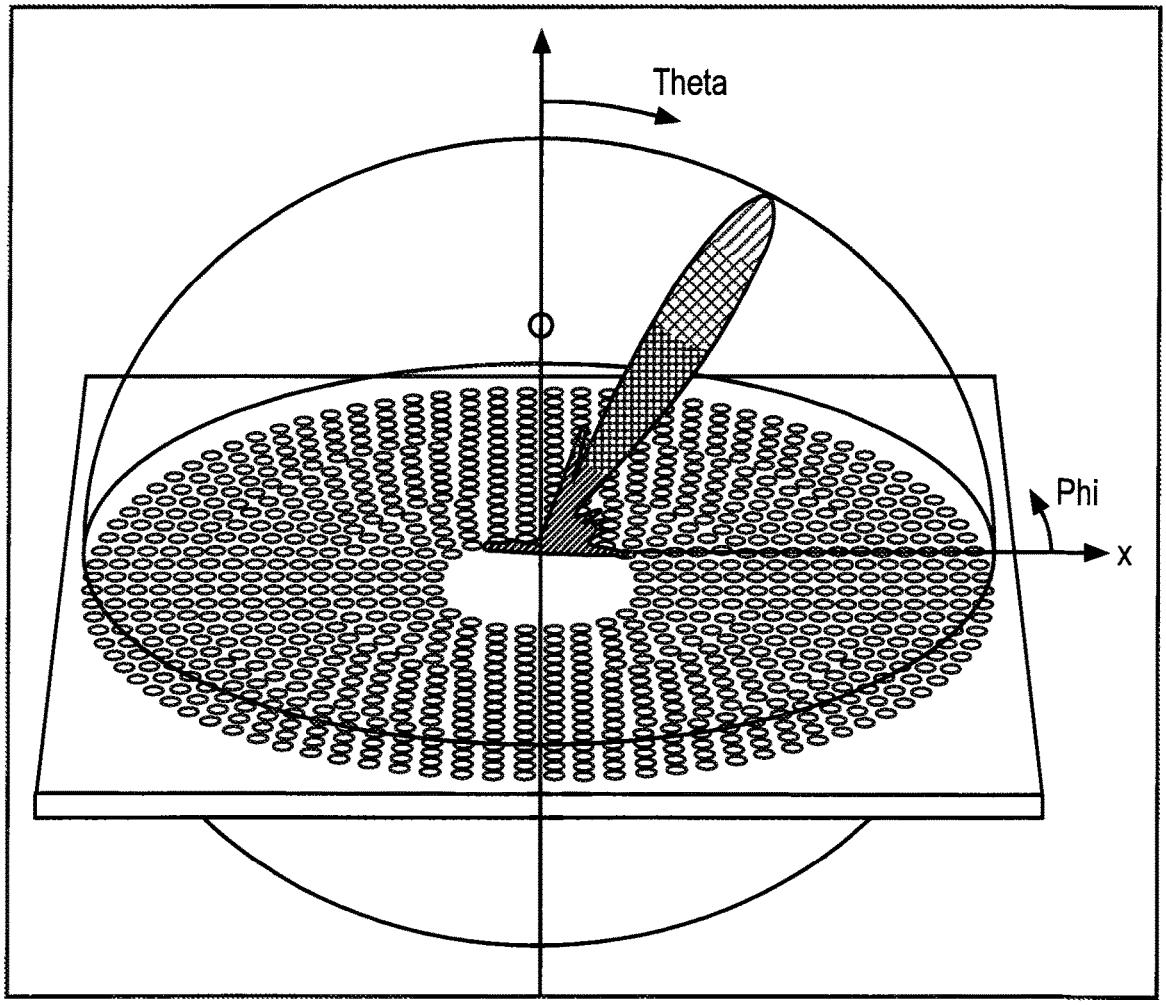

FIG. 15B is an example of a control pattern for a ring based slotted array, such as depicted in FIG. 15A. The resulting near fields and far fields for a 30° beam pointing with LHCP are shown in FIG. 15C, respectively.

In one embodiment, the feed structure is shaped to control coupling to ensure the power being radiated or scattered is roughly constant across the full 2D aperture. This is accomplished by using a linear thickness taper in the dielectric, or analogous taper in the case of a ridged feed network, that causes less coupling near the feed point and more coupling away from the feed point. The use of a linear taper to the height of the feed counteracts the 1/r decay in the travelling wave as it propagates away from the feed point by containing the energy in a smaller volume, which results in a greater percentage of the remaining energy in the feed scattering from each element. This is important in creating a uniform amplitude excitation across the aperture. For non-radially symmetric feed structures such as those having a square or rectangular outer dimension, this tapering can be applied in a non-radially symmetric manner to cause the power scattered to be roughly constant across the aperture. A complementary technique requires elements to be tuned differently in the array based on how far they are from the feed point.

One example of a taper is implemented using a dielectric in a Maxwell fish-eye lens shape producing an inversely proportional increase in radiation intensity to counteract the 1/r decay.

Figure 18:
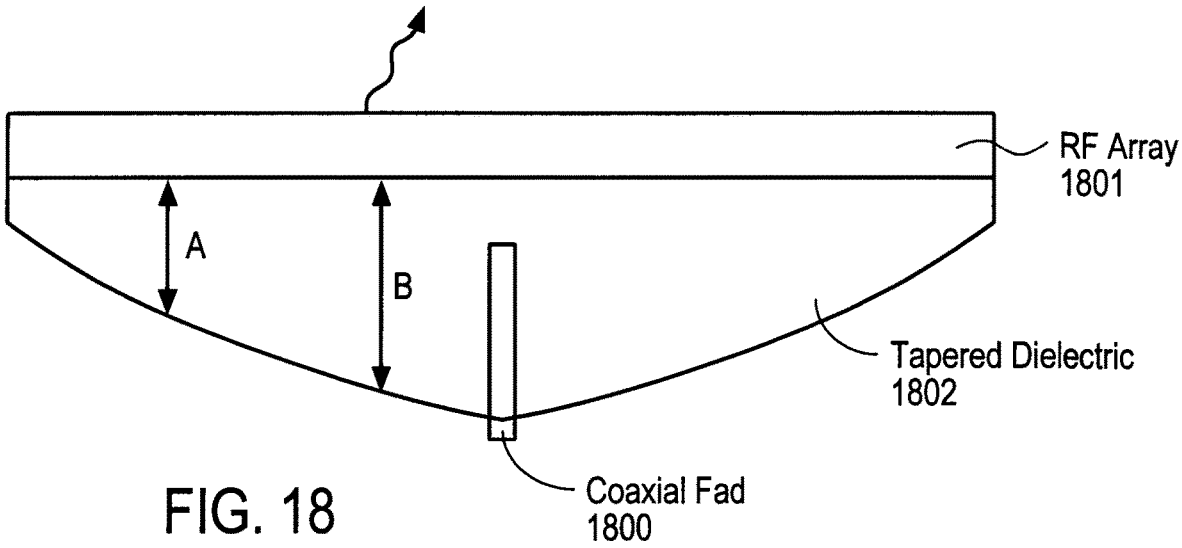
FIG. 18 illustrates a linear taper of a dielectric.

FIG. 18 illustrates a linear taper of a dielectric. Referring to FIG. 18, a tapered dielectric 1802 is shown having a coaxial feed 1800 to provide a concentric feed wave to execute elements (patch/iris pairs) of RF array 1801. Dielectric 1802 (e.g., plastic) tapers in height from a greatest height near coaxial feed 1800 to a lower height at the points furthest away from coaxial feed 1800. For example, height B is greater than the height A as it is closer to coaxial feed 1800.

In keeping with this idea, in one embodiment, dielectrics are formed with a non-radially symmetric shape to focus energy where needed. For example, in the case of a square antenna fed from a single feed point as described herein, the path length from the center to a corner of a square is 1.4 times longer than from the center to the center of a side of a square. Therefore, more energy must be focused toward the 4 corners than toward the 4 halfway points of the sides of the square, and the rate of energy scattering must also be different. Non-radially symmetric shaping of the feed and other structures can accomplish these requirements In one embodiment, dissimilar dielectrics are stacked in a given feed structure to control power scattering from feed to aperture as wave radiates outward. For example, the electric or magnetic energy intensity can be concentrated in a particular dielectric medium when more than 1 dissimilar dielectric media are stacked on top of each other. One specific example is using a plastic layer and an air-like foam layer whose total thickness is less than $\lambda_{eff}/2$ at the operation frequency, which results in higher concentration of magnetic field energy in the plastic than the air-like foam.

In one embodiment, the control pattern is controlled spatially (turning on fewer elements at the beginning, for instance) for patch/iris detuning to control coupling over the aperture and to scatter more or less energy depending on direction of feeding and desired aperture excitation weighting. For example, in one embodiment, the control pattern used at the beginning turns on fewer slots than the rest of the time. For instance, at the beginning, only a certain percentage of the elements (e.g., 40%, 50%) (patch/iris slot pairs) near the center of the cylindrical feed that are going to be turned on to form a beam are turned on during a first stage and then the remaining are turned that are further out from the cylindrical feed. In alternative embodiments, elements could be turned on continuously from the cylindrical feed as the wave propagates away from the feed. In another embodiment, a ridged feed network replaces the dielectric spacer (e.g., the plastic of spacer 205) and allows further control of the orientation of propagating feed wave. Ridges can be used to create asymmetric propagation in the feed (i.e., the Poynting vector is not parallel to the wave vector) to counteract the 1/r decay. In this way, the use of ridges within the feed helps direct energy where needed. By directing more ridges and/or variable height ridges to low energy areas, a more uniform illumination is created at the aperture. This allows a deviation from a purely radial feed configuration because the direction of propagation of the feed wave may no longer be oriented radially. Slots over a ridge couple strongly, while those slots between the ridges couple weakly. Thus, depending on the desired coupling (to obtain the desired beam), the use of ridge and the placement of slots allows control of coupling.

In yet another embodiment, a complex feed structure that provides an aperture illumination that is not circularly symmetric is used. Such an application could be a square or generally non-circular aperture which is illuminated non-uniformly. In one embodiment, a non-radially symmetric dielectric that delivers more energy to some regions than to others is used. That is, the dielectric can have areas with different dielectric controls. One example of is a dielectric distribution that looks like a Maxwell fish-eye lens. This lens would deliver different amounts of power to different parts of the array. In another embodiment, a ridged feed structure is used to deliver more energy to some regions than to others.

In one embodiment, multiple cylindrically-fed sub-aperture antennas of the type described here are arrayed. In one embodiment, one or more additional feed structures are used. Also in one embodiment, distributed amplification points are included. For example, an antenna system may include multiple antennas such as those shown in FIG. 2A or 2B in an array. The array system may be 3×3 (9 total antennas), 4×4, 5×5, etc., but other configurations are possible. In such arrangements, each antenna may have a separate feed. In an alternative embodiment, the number of amplification points may be less than the number of feeds.

Advantages and Benefits

Improved Beam Performance

One advantage to embodiments of the present invention architecture is better beam performance than linear feeds. The natural, built-in taper at the edges can help to achieve good beam performance.

In array factor calculations, the FCC mask can be met from a 40 cm aperture with only on and off elements.

With the cylindrical feed, embodiments of the invention have no impedance swing near broadside, no band-gap created by 1-wavelength periodic structures.

Embodiments of the invention have no diffractive mode problems when scanning off broadside.

Dynamic Polarization

There are (at least) two element designs which can be used in the architecture described herein: circularly polarized elements and pairs of linearly polarized elements. Using pairs of linearly polarized elements, the circular polarization sense can be changed dynamically by phase delaying or advancing the modulation applied to one set of elements relative to the second. To achieve linear polarization, the phase advance of one set relative to the second (physically orthogonal set) will be 180 degrees. Linear polarizations can also be synthesized with only element patter changes, providing a mechanism for tracking linear polarization Operational Bandwidth On-off modes of operation have opportunities for extended dynamic and instantaneous bandwidths because the mode of operation does not require each element to be tuned to a particular portion of its resonance curve. The antenna can operate continuously through both amplitude and phase hologram portions of its range without significant performance impact. This places the operational range much closer to total tunable range.

Smaller Gaps Possible with Quartz/Glass Substrates

The cylindrical feed structure can take advantage of a TFT architecture, which implies functioning on quartz or glass. These substrates are much harder than circuit boards, and there are better known techniques for achieving gap sizes around 3 um. A gap size of 3 um would result in a 14 ms switching speed.

Complexity Reduction

Disclosed architectures described herein require no machining work and only a single bond stage in production. This, combined with the switch to TFT drive electronics, eliminates costly materials and some tough requirements.

Whereas many alterations and modifications of the present invention will no doubt become apparent to a person of ordinary skill in the art after having read the foregoing description, it is to be understood that any particular embodiment shown and described by way of illustration is in no way intended to be considered limiting. Therefore, references to details of various embodiments are not intended to limit the scope of the claims which in themselves recite only those features regarded as essential to the invention.

We claim:

1. An antenna comprising:

a multi-layered structure having a bottom layer and a top layer with at least one side;

an antenna feed coupled to the bottom layer of the multi-layered structure to radially feed a feed wave that propagates outwardly and concentrically from the feed through the first layer, propagates to the top layer via reflection off the at least one side and then travels inwardly from the at least one side toward a central portion of the top layer;

a radio-frequency (RF) array of a plurality of surface scattering metamaterial antenna elements coupled to the multi-layered structure with a dielectric layer inside the array for propagating the cylindrical feed wave, wherein the feed wave interacts with surface scattering antenna elements of the RF array to generate a beam, wherein the array comprises an iris substrate with a plurality of slots at a top side of the iris substrate and a patch substrate with a plurality of patches at a bottom side of the patch substrate facing the iris substrate, wherein each of the patches is co-located over and separated from a slot in the plurality of slots using a liquid crystal layer and forming a patch/slot pair in a stacked relationship, each patch/slot pair being configured to be controlled based on application of a voltage to the patch in the pair specified by a control pattern; and a controller configured to apply the control pattern to control the plurality of surface scattering metamaterial antenna elements to generate a beam when the cylindrical feed wave interacts with the plurality of surface scattering metamaterial antenna elements, wherein each surface scattering antenna element of the plurality of surface scattering antenna elements is tuned to provide a desired scattering at a given frequency by using a voltage from the controller to dynamically reconfigure the beam.

2. The antenna defined in claim 1 further comprising a controller coupled to the RF array and operable to apply a control pattern to cause generation of the beam.

3. The antenna defined in claim 2 wherein the controller is operable to adjust an interference pattern to provide arbitrary antenna radiation patterns by identifying the interference pattern corresponding to a selected beam pattern and then adjusting the voltage of antenna elements of the RF array to produce the beam.

4. The antenna defined in claim 1 wherein the RF array comprises a tunable slotted array of surface scattering antenna elements having a plurality of slots oriented at an angle relative to a propagation direction of cylindrical feed wave impinging at a central location of each slot in the plurality of slots, and wherein each slot is tuned to provide a desired scattering at a given frequency.

5. The antenna defined in claim 4 wherein the slotted array is dielectrically loaded.

6. The antenna defined in claim 4 wherein each slot of the plurality of slots is oriented either +45 degrees or −45 degrees relative to the cylindrical feed wave impinging at the central location of said each slot, such that the slotted array includes a first set of slots rotated +45 degrees relative to the cylindrical feed wave propagation direction and a second set of slots rotated −45 degrees relative to the propagation direction of the cylindrical feed wave.

7. The antenna defined in claim 1 further comprising liquid crystal between each slot of the plurality of slots and its associated patch in the plurality of patches.

8. The antenna defined in claim 1 further comprising a coaxial pin to supply the feed wave to the multi-layered structure.

9. The antenna defined in claim 1 wherein the top layer comprises a dielectric layer and the bottom layer comprises a spacer layer.

10. The antenna defined in claim 9 wherein the spacer layer comprises a foam layer.

11. The antenna defined in claim 9 wherein the dielectric layer comprises plastic.

12. The antenna defined in claim 1 further comprising a ridged feed network into which the cylindrical feed wave travels.

13. An antenna comprising:

an antenna feed to input a feed wave that propagates concentrically from the feed;

a layer through which the feed wave travels;

a plurality of radio-frequency (RF) radiating antenna elements coupled to the antenna feed, wherein the array comprises an iris substrate with a plurality of slots at a top side of the iris substrate and a patch substrate with a plurality of patches at a bottom side of the patch substrate facing the iris substrate, wherein each of the patches is co-located over and separated from a slot in the plurality of slots using a liquid crystal layer and forming a patch/slot pair in a stacked relationship, such that patch and iris pairs have liquid crystal between the patch and iris of each of the pairs; and a controller coupled to the plurality of RF radiating antenna elements to control each patch and iris based on an applied voltage specified by a control pattern, wherein the feed wave interacts with pairs to generate a beam when the cylindrical feed wave impinges irises of the patch and iris pairs, wherein each surface scattering antenna element of the plurality of surface scattering antenna elements is tuned to provide a desired scattering at a given frequency by using a voltage from the controller to dynamically reconfigure the beam.

14. The antenna defined in claim 13 wherein the controller is operable to adjust an interference pattern to provide arbitrary antenna radiation patterns by identifying the interference pattern corresponding to a selected beam pattern and then adjusting the voltage across the pairs to produce the beam.

15. The antenna defined in claim 13 wherein the radio-frequency (RF) radiating antenna elements comprise surface scattering antenna elements.

16. The antenna defined in claim 15 wherein irises are oriented at an angle relative to a propagation direction of feed wave impinging at a central location of each iris and each pair is tuned to provide a desired scattering at a given frequency.

17. The antenna defined in claim 13 further comprising a coaxial pin to supply the feed wave.

18. The antenna defined in claim 13 further comprising a patch substrate having a plurality of patches and an iris substrate having a plurality of iris.

19. The antenna defined in claim 13 wherein the controller is operable to cause polarization to change by delaying modulation applied to one portion of the pairs relative to another portion of the pairs.

* * * * *